US006888130B1

(12) United States Patent
Gonin

(10) Patent No.: US 6,888,130 B1
(45) Date of Patent: May 3, 2005

(54) ELECTROSTATIC ION TRAP MASS SPECTROMETERS

(76) Inventor: Marc Gonin, Aarstrasse 62, 3011, Bern (CH)

( * ) Notice: Subject to any disclaimer, the term of this patent is extended or adjusted under 35 U.S.C. 154(b) by 0 days.

(21) Appl. No.: 10/449,328

(22) Filed: May 30, 2003

Related U.S. Application Data

(60) Provisional application No. 60/383,781, filed on May 30, 2002.

(51) Int. Cl.[7] ..... H01J 49/40

(52) U.S. Cl. ..... 250/287; 250/294; 250/281

(58) Field of Search ..... 250/281, 282, 250/283, 287, 294, 297

(56) References Cited

U.S. PATENT DOCUMENTS

| | | | | | |
|---|---|---|---|---|---|
| 3,621,242 | A | * | 11/1971 | Ferguson et al. | 250/287 |
| 3,727,047 | A | | 4/1973 | Janes | |
| 4,072,862 | A | | 2/1978 | Mamyrin et al. | |
| 4,507,555 | A | * | 3/1985 | Chang | 250/281 |
| 4,731,532 | A | | 3/1988 | Frey et al. | |
| 4,988,879 | A | * | 1/1991 | Zare et al. | 250/282 |
| 5,017,780 | A | | 5/1991 | Kutscher et al. | |
| 5,696,375 | A | * | 12/1997 | Park et al. | 250/287 |
| 5,880,466 | A | | 3/1999 | Benner | |
| 5,886,346 | A | | 3/1999 | Makarov | |
| 5,905,258 | A | * | 5/1999 | Clemmer et al. | 250/287 |
| 6,013,913 | A | | 1/2000 | Hanson | |
| 6,020,586 | A | * | 2/2000 | Dresch et al. | 250/287 |
| 6,040,575 | A | * | 3/2000 | Whitehouse et al. | 250/287 |
| 6,107,625 | A | * | 8/2000 | Park | 250/287 |
| 6,208,951 | B1 | * | 3/2001 | Kumar et al. | 702/191 |
| 2002/0190200 | A1 | * | 12/2002 | Zajfman et al. | 250/287 |

FOREIGN PATENT DOCUMENTS

| | | | |
|---|---|---|---|
| DE | 44 08 489 | 9/1995 | |
| DE | 4408489 A1 * | 9/1995 | H01J/49/40 |

OTHER PUBLICATIONS

Dahan et al., "A new type of electrostatic ion trap for storage of fast ion beams", Rev. Sci. Instrum. 69 (1), Jan. 1998, pp. 76–83.*

Bateman, H. et al., "Micromass," Proc. 48th ASMS Conference, Long Beach, California (2000).

Benner, W. H., "Analytic Chemistry," 69 (1997) pp 4162–4168.

Bergmann et al., "Rev. Sci. Instrum.," 61/10 (1990) p 2585.

Hanson, C.D., 47th ASMS Conference, Dallas, Texas (1999).

Makarov, HD Technologies, 47th ASMS Conference, Dallas, Texas (1999).

Park, Melvin, Brucker Daltonics Inc., 48th ASMS Conference, Long Beach, California (2000).

Park, Melvin, Brucker Daltonics Inc., 46th ASMS Conference, Orlando, Florida (1998) p 883.

Piyadasa, C.K.G. et al., "A High Resolving Power Multiple Reflection MALDI TOF," Rapid Commun. Mass Spectrometry, 13 (1999) pp 620–624.

(Continued)

*Primary Examiner*—Jack I. Berman
(74) *Attorney, Agent, or Firm*—Jacox Meckstroth & Jenkins

(57) ABSTRACT

An improved electrostatic ion trap mass spectrometer based on two reflectrons and Fourier Transform analysis is disclosed. An ensemble of ions with a kinetic energy falling into a certain range will do isochronous oscillations in this reflectron trap. The image charge transient of those oscillations is processed with a data acquisition system similar to those used in FT-MS to get a mass spectrum. Various application-specific ion extractors, ion storage prior to extraction, MS/MS techniques and $MS^n$ techniques are also disclosed.

46 Claims, 17 Drawing Sheets

OTHER PUBLICATIONS

S. Ring, H.B. Pedersen, O. Heber, M.L. Rappaport, P.D. Witte, K.G. Bhushan, N. Altstein, Y. Rudich, I. Sagl, and D. Zajfman, "Fourier Transform Time–of–Flight Mass Spectrometry in an Electrostatic Ion Beam Trap," Analytic Chemistry, 72 (2000), p 4041–4046.

Rockwood, A.L., J. Am. Soc. Mass Spectrometry, 10/3 (1999) p 241.

Scherer et al., "Prototype of a Reflection Time–of–Flight Mass Spectrometer for the Rosetta Rendevous Mission," Proc. 46th ASMS Conference, Orlando, Florida (1998) p 1238.

Wollnik, H. and M. Przewloka, "Time–of–Flight Mass Spectrometers with Multiply Reflected Ion Trajectories," International Journal of Mass Spectrometry and Ion Processes, 96 (1990), pp 287–274.

Wollnik, H. et al., 47th ASMS Conference, Dallas, Texas (1999).

Wollnik, H. et al., 48th ASMS Conference, Long Beach, California (2000).

Zajfman, D. et al., Phys. Rev.A, 55/3 (1997) p R1577.

* cited by examiner

ELECTROSTATIC ION TRAP MASS SPECTROMETERS

RELATED APPLICATION

This application is a continuation of Provisional application 60/383,781 filed May 30, 2002, which is incorporated herein by reference and made a part hereof.

BACKGROUND OF THE INVENTION

Definition of Terms

TOF: Time-of-flight mass spectrometer.

Multi-reflection: A TOF with more than one reflector (also called reflectron) is referred to as a multi reflection TOF.

Multi-path: A TOFMS where one ion path is followed multiple times is referred to as a multi-path TOF.

V-path: V-shaped path of ions in a TOF. This is currently the most common path in TOFs. Ions start in the extraction, fly down to the reflector and then up to the detector.

W-path: W-shaped path of ions.

I-path: With an I-shaped ion path, the ions always fly along the same axis.

Isochronous oscillation: An ion oscillation whose frequency is independent of the ion energy is referred to as an isochronous oscillation.

Time-of-flight: The time it takes an ion to transverse one (or several) ion optical elements. In general, this time is a function of the initial properties of the ion:

$$T=T^{+}(K, Y, Z, A, B) \tag{1}$$

Where K is the initial kinetic energy of the ion, Y and Z are the initial positions of the ion and A and B define the initial direction of the ion's motion. For convenience the above function is often transformed to a coordinate system defined by some reference ion. The time-of-flight function is then $$T=T^{+}(\delta_1, y_1, z_1, \alpha_1, \beta_1) \tag{2}$$

Where $\delta=(K^R-K)K^R=\Delta K/K^R$ is the initial kinetic energy difference relative to the reference ion kinetic energy $K^R$, y and z define the initial position relative to the reference ion, and $\alpha$ and $\beta$ define the initial direction relative to the reference ion. The Taylor expansion of this function is:

$$T^{+}(\delta,y,z,\alpha,\beta)=T_0+(\partial T/\partial\delta)\delta+(\partial T/\partial y)y+(\partial T/\partial z)z+(\partial T/\partial\alpha)\alpha+(\partial T/\partial\alpha)\alpha+(\partial T/\partial\beta)\beta+\text{terms of higher order} \tag{3}$$

This is often written as $$T^{+}(\delta,y,z,\alpha,\beta)=T_0+(T/\delta)\delta+(T/y)y+(T/z)z+(T/\alpha)\alpha+(T/\beta+\text{terms of higher order} \tag{4}$$

$T_0$ denotes the time-of-flight of the reference ion, whereas the sum of all other terms is called the time error $\Delta T$ of the ion under consideration caused by its initial conditions. For now we look at an ion that starts at the same position with the same direction as the reference ion, hence $y=z=\alpha=\beta=0$. We also assume that this ion (as the reference ion) moves on the axis of an axial symmetric ion reflector. Because of symmetry reasons, this ion will stay on the axis and we get:

$$T(\delta)=T_0+(\partial T/\partial\delta)\delta+(\partial^2T/\partial\delta^2)/2\delta^2+(\partial^2T/\partial\delta^2)/6\delta^3+ \tag{5}$$

Or in the short notation:

$$T(\delta)=T_0+(T/\delta)\delta+(T/\delta^2)\delta^2+(T/\delta^3)+\ldots T_0+\Delta T \tag{6}$$

$$\Delta T(\delta)=(T/\delta)\delta(T/\delta^2)\delta^2+(T/\delta^3)\delta^3+ \tag{7}$$

Time focusing: An ion optical system with $(T/\delta)=0$ is called first order time focusing. If in addition $(T/\delta^2)=0$ then it is called second order time focusing, and so on.

Dispersion: In this patent we only consider time dispersion. The time dispersion of an ion traversing an ion optical element is the time error caused by energy deviation $\Delta T(\delta)$ that this ion has relative to some reference ion. In a perfectly isochronous system, per definition, this dispersion is $\Delta T(\delta)=0$. A fieldless drift section has a negative dispersion, meaning that ions of higher energies will require less time to traverse the system than the reference ion. An ion reflector may have a negative or a positive dispersion and, if adjusted correctly, can compensate the negative dispersion of a drift section so that the combination of the two become an isochronous system.

Reflectron: An ion reflector with positive dispersion, which is able to compensate to second order the dispersion of a drift tube.

FRT: Fourier reflectron trap, the instrument disclosed in this patent.

1. Field of Invention

The invention is a mass spectrometer (MS), a method for qualitative and/or quantitative chemical and biological analysis. It is a merger of an ion trap (IT) MS and a time-of-flight (TOF) MS.

2. Description of Prior Art

The ion reflector for compensation of time errors in TOFs was first proposed by Alikanov in 1957. In 1973 a US patent for such a device was granted to Janes U.S. Pat. No. 3,727,047. A two-stage ion reflector (reflectron) was proposed by Mamyrin in 1966 in order to increase the resolving power of their instrument, Mamyrin et al, U.S. Pat. No. 4,072,862. The two stages allowed for second order time error compensation in combination with a drift section. Grids of high transparency were used to obtain two stages of linear fields. Such a two-stage reflector allows obtaining a total ion flight path of good isochronous quality in a TOF.

Later, a godless reflectron was developed by Frey et al., U.S. Pat. No. 4,731,532, in order to reduce the loss of ions. This gridless reflector consisted of coaxial rings. In most cases, the electric potential of those rings are chosen in a way that generates two sections of more or less linear fields on the axis of the reflector. In order to compensate the defocusing properties of such a gridless reflector, a focusing lens is added in front of the reflector. This so-called reflector lens may be an accelerating or a retarding lens. Because accelerating lenses produce smaller time errors to the time-off-light of the ions, mostly accelerating lenses are used.

Gridless reflectors require a set of rings and many adjustable voltages to regulate the voltages of these rings. In order to facilitate the construction, reflectors from resistive films or materials were introduced. Another approach replaced the ring structure with conductive traces on PCB boards.

Time-of-flight mass spectrometers with multiple reflections were suggested rather early in 1990, see Wollnik and Prezewloka, Time-of-Flight Mass Spectrometers with Multiply Reflected Ion Trajectories, International Journal of Mass Spec. and Ion Processes, 96 (1990) 267–247, but their popularity grew only in the last few years. A W-shaped path was presented by the University of Bem in 1998 (S. Scherer et al., Prototype of a Reflectron, time-of-flight mass spectrometer for the Rosetta rendevous mission, Proc. 46th ASMS Conference, Orlando, Fla., 1998, p. 1238), and then was also incorporated in a commercial instrument by Micromass in 2000 (H. Bateman et al., Micromass, Proc. 48th ASMS Conference, Long Beach, Calif., 2000). Simultaneously, the Wollnik group started to design instruments where ions make multiple reflections passing a V-shaped path several times (H. Wollnlik et al., 47th ASMS Conference, Dallas, Tex., 1999). In 1999, a group from University of Uppsala presented a multi reflection I-path Maldi-TOF that used grided reflectors and electron multipliers (C.K.G. Piyadasa et al., A High Resolving Power Multiple Reflection, MALDI TOF, Rapid Commun. Mass Sprectrom. 13, 1999, p. 620–624). This instrument was designed to analyze a population of ions. In 1999 Hanson presented an I-path multi reflection instrument with a wire guide and grided reflectors (C. D. Hanson, 47th ASMS Conference, Dallas, Tex.,1999). In 2000, the group of Wollnik presented an I-path instrument with gridless reflectors (Wollnik et al., 48th ASMS Conference, Long Beach, Calif., 2000), and at the same time Brucker Daltonics presented a commercial ESI instrument with I-path multi-reflection using a grided reflector (Melvin Park, Brucker Daltonics, Inc., 48th ASMS Conference, Long Beach, California, 2000).

Some of those I-path TOFs have resolving powers mrnAm of several times 10'000. The drawback is that the useful mass window gets more and more restricted, as more multiple paths are done. One method to overcome this limitation has been presented by Makarov in 1999 (Makarov, HD Technologies, 47th ASMS Conference, Dallas, Tex., 1999): he built an isochronous ion trap (Orbitrap) using only a static electric field. Static electric fields may not be used to trap ions at rest, but if the ions have sufficient kinetic energies and the correct starting conditions, it is possible to trap ions with static electric fields. Seeing Makarov's ion trap, I realized, that isochronous reflectors as used in TOFs can also be used make an electrostatic isochronous ion trap, where the oscillation frequencies of the ions are sensed by a pick up electrode.

Already in 1994, Strehle patented an electrostatic ion trap with two opposing reflectors, an I-shaped flight path and an image charge detector, sensing the ion oscillations in the trap. As in the Makarov trap, the Fourier Transform of this signal would yield the ion oscillation frequencies. From those frequencies the ion masses can easily be calculated. This instrument was very innovative, because it did not use an electron multiplier detector as TOFs usually do, but it used a tubular pick up electrode to sense the repetitive, induced signal from the trapped ion passing through this electrode.

In 1997, the group of Prof. Benner used a similar instrument in order to determine the mass, charge and velocity of large individual ions (W. H. Benner, Anal Chem. 69, 1997, p. 4162–4168). However, there were some fundamental differences to the instrument taught by Strehle:

a) Benner did not use isochronous reflectors, hence his trap worked best with only one ion oscillating in the trap. Using several ions (of the same specie) would have lead to a temporal dispersion of those ions because it is not possible to generate all ions monochromatically (with the same energy). The lack of isochronity would have degraded the signal, thus preventing the measurement with high resolving powers. This lack of isochronity, however, did not play a role in the experiments he was interested in, namely the detection of mass and charge of extremely large multiply charged ions.

b) The pick up transient was not Fourier transformed in order to get the mass spectrum. Instead, the oscillation time of the ion in the trap was determined by measuring the time difference between the pick up signal peaks. In order to get reliable measurements, these peaks hence had to be quite much larger than the electronic noise. Therefore, only multiply charged ions could be measured with this instrument. Also, only few ions of different species could be measured simultaneously so that the pick-up signal of those ions were not confused. The amplitude of the pick up signal was used to measure the charge state of the ion.

In 1999 A.L. Rockwood from Sensar Larsen-Davies Corp. published an article (A.L. Rockwood, Journal American Society Mass Spectrometers, 10/3 (1999), p. 241) where he recognized that the Benner trap could be used for the analysis of several ions if the reflectors could be made isochronous. He presented simulations that showed a resolving power of up to 6000 for an ion package making several reflections, using very simple first order time focussing reflectors. In his paper, however, he did not discuss injection and detection of the ions.

The possibility to store ion packages in an electrostatic reflector trap was also demonstrated by Zajfman et. al. in 1996 (D. Zajfman et al., Phys. Rev. A 55/3, 1997, p. R1577). In July 2000, this group changed its storage trap into an isochronous reflectron trap and demonstrated quite high resolving power (Ring, H. B. Pedersen, O. Heber, M. L. Rappaport, P. D. Witte, K. g. Bhushan, N. Altstein, Y. Rudich, I. Sagi, and D. Zajfman; Fourier Transform Time-of-Flight Mass Spectrometry in an Electrostatic Ion Beam Trap: Anal. Chem. 72 (2000) p. 4041–4046) using EI and MALDI.

SUMMARY OF THE INVENTION

Mass spectrometers in general consist of an ionizer, an ion extractor/injector, a mass analyzer, a data acquisition system and a data processing system.

Mass Analyzer

The disclosed Fourier reflectron trap mass spectrometer (FRT) uses a novel mass analyzer, an electrostatic ion trap, similar to the Orbitrap (Makarov, H.D Technologies, 47th ASMS Conference, Dallas, Tex., 1999). The trap consists of two gridless reflectrons facing each other and a fieldless drift path section in between. The ion optical configuration of this trap has to fulfill two requirements in order to work properly: First the reflectors must be focusing mirrors where the focus length f meets the following criteria (D. Zajfman et al., Phys Rev. A 55/3, 1997, p. R1577):

$$L/4 \leqq f \leqq \infty \tag{8}$$

Where L is the length of the trap. This stability criteria ensures that the ions can stay on stable trajectories in the trap during their oscillations until they eventually undergo a collision, e.g. with a residual gas particle. Second, there must be an ion energy range in which ions perform close to isochronous oscillations in the trap. This is achieved if the time dispersion of the drift is compensated by the time dispersion of the reflectors. The dispersion of one oscillation should be close to constant:

$$\Delta T(\delta) \approx 0. \text{ for } \delta \epsilon [1-\epsilon, 1+\epsilon] \text{ and } \epsilon < 0.1 \tag{9}$$

This is accomplished if at least the first order term (T/δ) of the Taylor expansion of the oscillation time is equal to zero.

$$\Delta T(\delta) = (T/\delta)\delta + (T/\delta^2)\delta^2 + (T/\delta^3)\delta^3 + \tag{10}$$

It is well known that first and even second order time focusing can be achieved with a gridless reflectron. If such a reflectron includes a lens at the entry of the reflectron, it can also satisfy the stability criteria (8). The isochronity will be obtained for a limited energy range only, which is a drawback compared to the Orbitrap, however, the energy spread is sufficient for most ion injection methods, especially for those generating ions from a surface.

Data Acquisition System

Like in the Orbitrap, the oscillations of all ions will be registered with one or several pick up electrodes and the mass spectrum will be received by a Fourier transformation of the pick up transient. An alternative method would use a coil that senses the charged particles traversing through the coil. Both detection schemes allow the detection of very large ions, that would have low detection efficiencies on electron multiplier detectors which are usually used in TOF instruments. Low noise amplifiers are used to amplify the signals prior to the Fourier transformation. The use of a Fourier transform method increases the sensitivity of the instrument considerably compared to the instrument described by Benner, because the Fourier transformation will identify oscillation frequencies even if the individual signals of each ion passage through the pick up electrode are well within the noise level. Hence, the FRT will eventually be capable of detecting single ions carrying single charges. The m/z value of each ion specie is determined from the oscillation frequency f by:

$$m/z=a/f^2 \tag{11}$$

where a is a constant that includes all instrumental parameters (size, voltages). a can be determined with the oscillation frequency of a known ion by:

$$a=m/z\cdot f^2 \tag{12}$$

Other transformations (e.g. wavelet transformation) are also be applicable in this instrument type.

Ionizers and Ionization Methods

A wide part of this disclosure teaches the use of different ionizers and ionization methods in combination with the novel mass analyzer. It also addresses the methods to extract the ions from the ionizers and the methods to inject the ion into the reflectron trap. In order to simplify the discussion, the ionization methods are classified into ionization methods which produce ions from surfaces and those that produce ions in a volume. Surface extraction methods include laser ablation (LA), laser desorption (LD), matrix assisted laser desorption (MALDI), secondary ion mass spectrometry (SIMS), and ionization of recoiled ions (MSRI). Volume ionization methods include electron impact ionization (EI), electrospray ionization (ESI), several methods of photo ionization (PI), chemical ionization (CI), several methods of plasma ionizations like ionization in an inductively coupled plasma (ICPMS) and glow discharge ionization (GDI). These lists are not complete; more methods exist which can be assigned to either of these two categories.

It is useful to distinguish two categories of ion extraction/injection methods, those that extract ions from a surface (FIG. 7) and those that extract the ions from a volume (FIG. 6, FIG. 8). Some ionization methods are combined with several extraction methods that may not belong to the same category. For example, MALDI is a surface ionization method and it was traditionally used in combination with a surface extraction method. Recently, however, it was found to be of advantage to use a volume extraction method with MALDI. This is done by producing a primary beam from the MALDI ions and to extract the ions orthogonally from the volume of this beam into the TOF analyzer.

In order to analyze the structure of molecules by MS it is often not sufficient to have high mass resolution. This is especially true when analyzing isomers and even more with structural isomers which contain exactly the same atoms in different structural configuration. In such a case tandem mass spectrometry techniques have to be used (MS/MS). This technique requires parent ion selection and isolation, parent ion fragmentation, and fragment analysis. This procedure can be repeated more than one time, in which case it is called MSn. It is a major aim of this patent to disclose MS/MS techniques for a FRT and other improvements in order to improve the usefulness of a FRT for structural analysis of molecules.

Problems Solved

The disclosed instrument obtains high resolving powers and MS/MS capabilities with compact physical design. This type of mass spectrometer will be useful for a wide range of chemical and biological analyses, especially when the structures of high mass molecules are to be analyzed, or when compact instrument size is of importance. Also, the sensitivity is improved due to the use of Fourier transform data acquisition compared to previous instruments of similar technology.

Another advantage compared to the traditional TOF technique is that the ions are analyzed non-destructively. Hence, after their identification, the ions can be used in further processes. For example they can be selectively soft landed onto a surface or they can be injected into a further step of chemical analysis.

Figure 1:
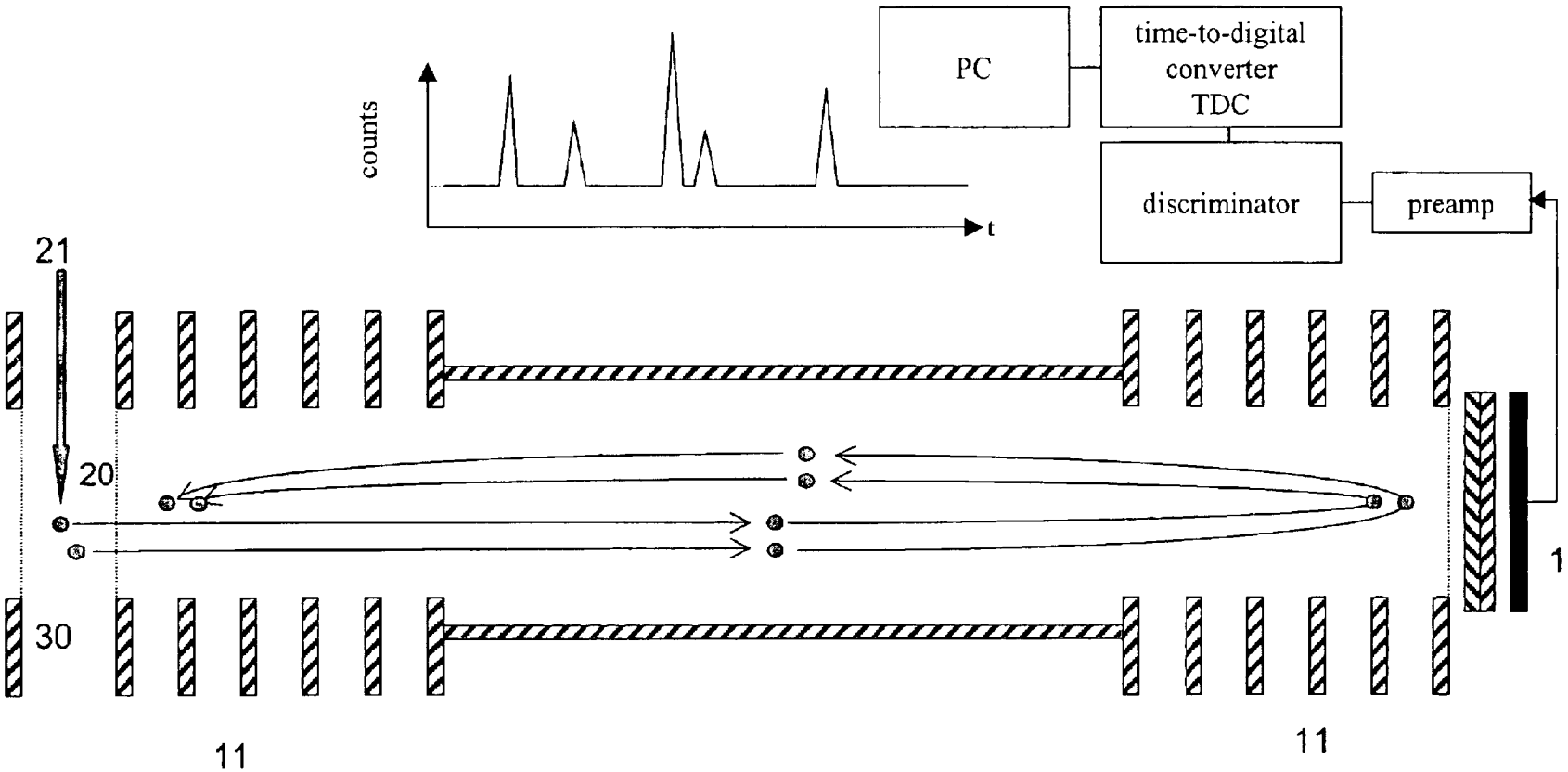
FIG. 1 (prior art)
FIG. 1. State of the art multi-path TOF comprising of ion production method (20), 2 reflectrons (11), and an electron multiplier detector (1). An ionizing beam, e.g. a laser beam, an electron beam, an ion beam, or a metastable atom beam (21) is used for the ionization.
Figure 2:
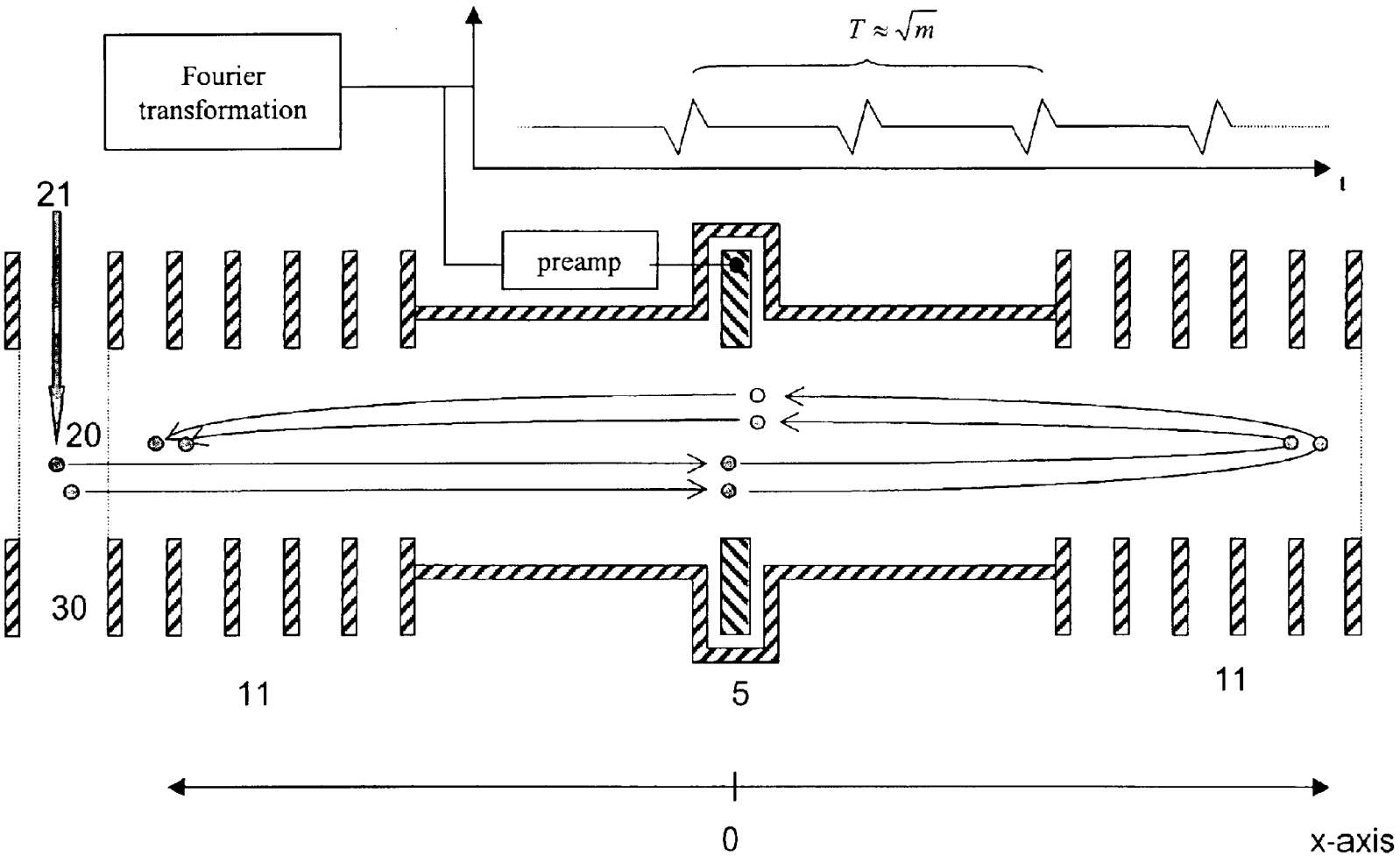
FIG. 2. Electrostatic ion trap comprising of ion production method (20), ion injector (30), 2 reflectors (11), and ring shaped pick up electrode (5). A coil for inductive signal pick-up can replace the ring shaped pick up electrode.
Figure 3:
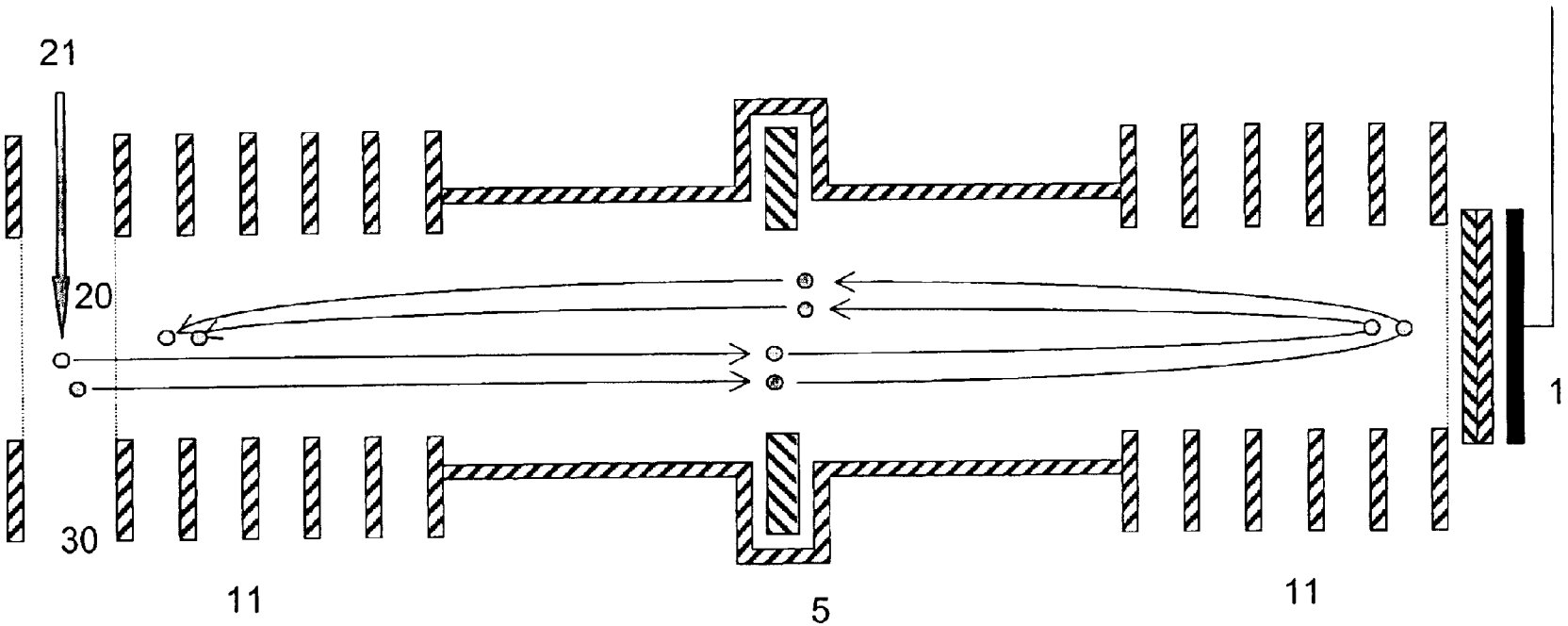
FIG. 3. Two-mode instrument that can run in ion trap mode, using the pick up electrode (5), or in TOF mode, using the MCP detector (1).
Figure 4:
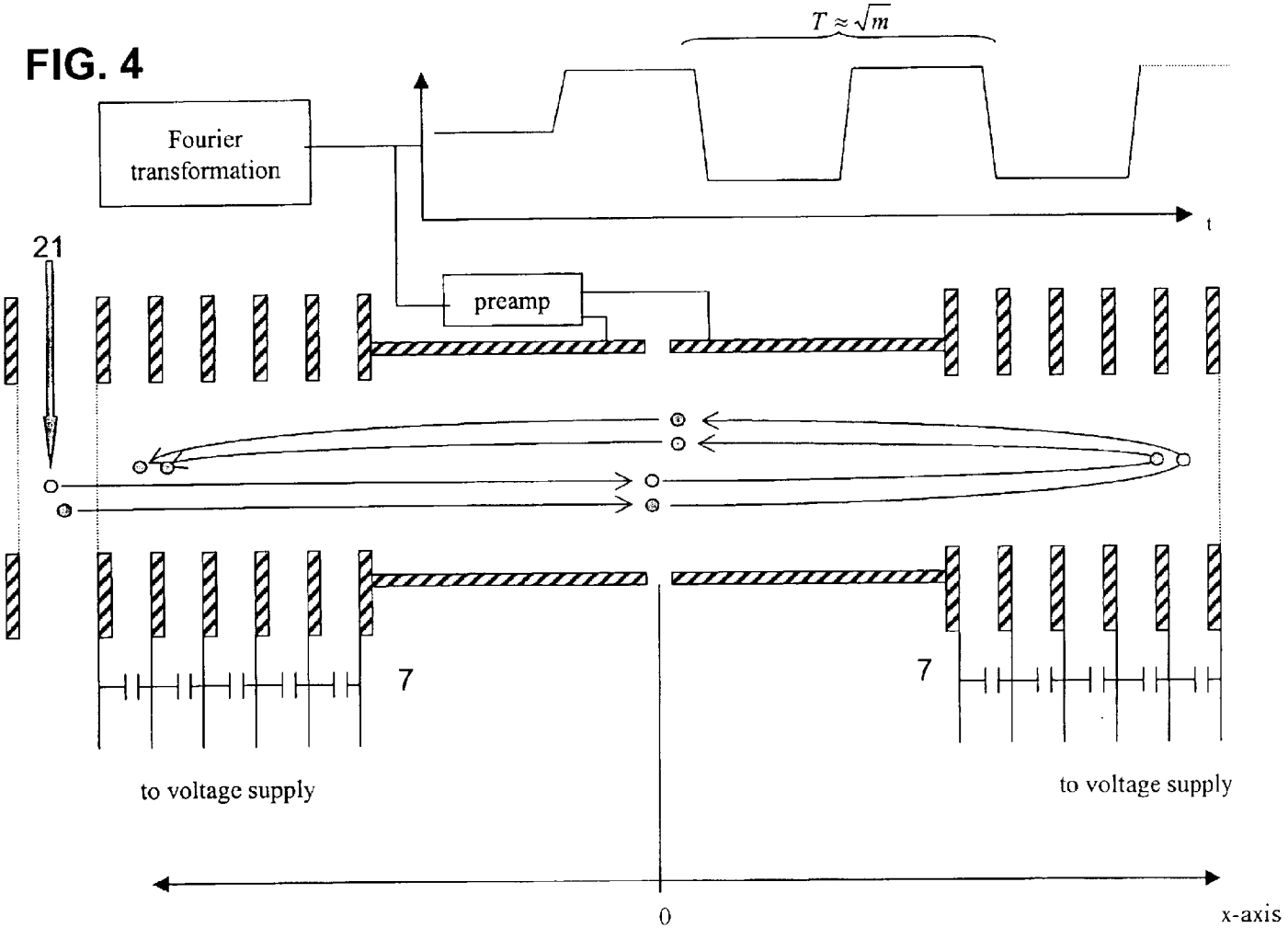
FIG. 4. Electrostatic ion trap with "cap" pick up electrodes (7), similar as used in the Orbitrap. Both reflectors (11) of the trap are high frequency coupled and hence may be used to detect the oscillation transient more effectively as the ring pick up electrode of FIG. 2.

This invention describes an isochronous reflector trap, which works very similar to the Orbitrap (see Makarov, HD Technologies, 47th, ASMS Conference, Dallas, Tex., 1999), but uses a different electrostatic field configuration to obtain the isochronous oscillations. Conventional multi-path TOFs (FIG. 1) have the drawback of a limited mass window. The Fourier transform data acquisition method used in ion traps does not have this restriction. The isochronous reflectron trap FIGS. 2 to 4) can record whole spectra at high resolving power. The isochronous reflectron trap may be combined with a multi-path TOF (FIG. 3). The transient of the ion oscillations is recorded with a ring(or tube-) shaped pick-up electrode (FIG. 2). An alternative method is to split the reflector trap in two parts and use the differential signal of both sides as the pick-up transient (FIG. 4). In order to do this, the electrostatic elements of either side have to be high-frequency connected. Then, the transient pick-up will be very similar to the transient pick-up in a FT-MS or in the Orbitrap.

The reflector trap is preferably built with gridless reflectors. This way, the trapped ions will survive longer and hence the signal transient will experience much less damping.

Isochronity

In order to obtain high resolving power, the ions in the reflector trap need to oscillate isochronously. This means that the oscillation frequency of all ions of a certain mass needs to be energy independent, at least for a certain range of kinetic energies. Current multi-path multi-reflector TOFs which obtain high resolving powers indicate, that this requirement is feasible. There is, however, a fundamental difference in the isochronity requirements of a multi-reflection TOF and a reflector trap: in the multi-reflection TOF, only the total flight path needs to be isochronous. This means that the total path consisting of ion injection, the oscillations, and the ion ejection needs to be isochronous. In case of the reflectron trap it is required that each oscillation or half oscillation is isochronous.

Hard Mirrors

Instead of using a symmetric design with two reflectrons, it is possible to use two unequal reflectors facing each other. In a preferred embodiment of this concept, one reflector is a so called hard mirror with a simple design (see S. Scherer et al., Prototype of a Reflectron Time-of-Flight Mass Specometer for the Rosetta Rendevous Mission, Proc. 46th ASMS Conference, Orlando, Fla., 1998, p. 1238), which only reflects ions but does not contribute significantly to the isochronity, e.g. does only minor dispersion compensation. The other reflector, however, is a reflectron with a dispersion to compensate for the entire oscillation. Such an asymmetric design has the advantage that it can be more compact.

Time-Focused Injection

Figure 5A:
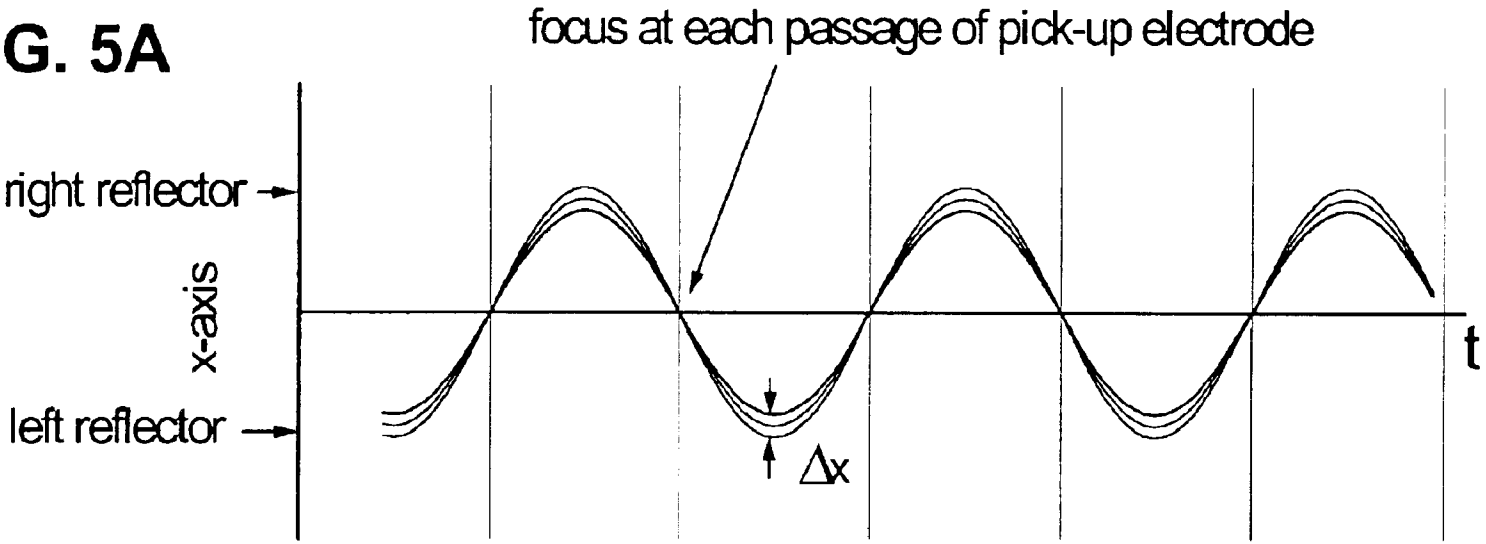
FIG. 5A. Illustration of the isochronous motion of the ions along the x-axis. Ions with higher energies plunge further into the reflector and hence travel a longer path, which compensates for their higher energy.
Figure 5B:
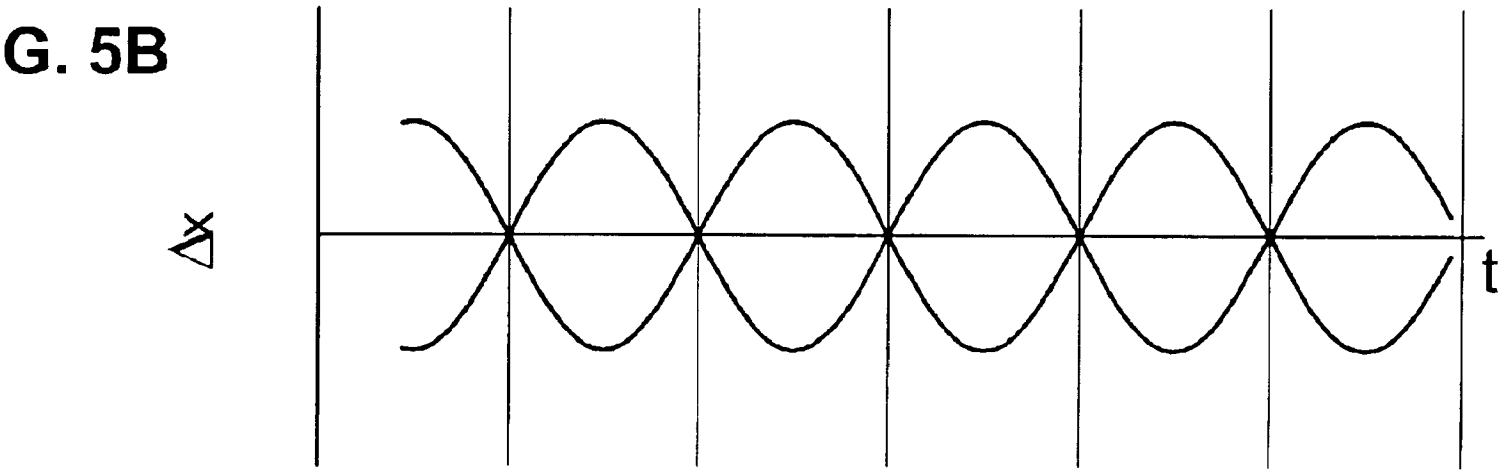
FIG. 5B. Illustration of the deviation of particles with higher energies and lower energies from the standard particle.

In a preferred embodiment the ions of each specie are kept in a narrow package when traversing the pick-up ring or the gap between the cap-electrodes at the center of the trap. It is hence of advantage to inject the ions in a way that after the injection, the ions have a first time focus exactly in the center of the trap, at the position of the pick up electrode. This time focus is then mirrored by the reflector into the same position with every oscillation or half oscillation (see FIG. 5).

The problem to make a time focus plane in the center of the trap is equivalent to the problem in a linear TOF with the TOF detector (the time focus of the linear TOF) being in the center of the trap. Hence, all time-focusing techniques developed for linear TOFs may be used, including time lag focusing (sometimes called delayed extraction). A time-focused injection is equivalent to a TOF-FRT combination. Such an instrument is of great interest if additional parent ion selection processes and parent ion fragmentation processes are added. An instrument with all these process stages would be, according to our nomenclature, a TOF/FRT.

Unfocussed Injection

This injection strategy does not try to make a time focus in the center of the trap. Instead, this method takes advantage of the possibility to make the resident time of the ions in the trap very long, and that in this case, the time errors produced by the injection become more and more irrelevant. Because of the long residence times, the time focussing of the ions in the center of the trap does not need to be as good as in the case of TOF instruments. This is why the ion extraction systems for the traps can be built simpler than TOF extractions. The relatively complicated orthogonal extraction systems in FIGS. 6C and 6D may be simplified, e.g, by using a multi deflector with just a few or even just one deflector in FIG. 6C, or by using just the tilted extraction, without the correction grid, in FIG. 6D. The disadvantage of the unfocussed injection is that more oscillations are required to obtain the same resolving power, which may implement the use of a better vacuum.

Figure 6B:
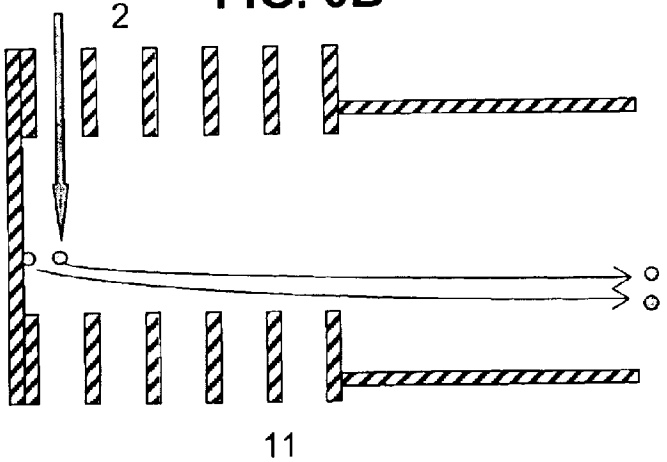
FIG. 6B. Primary ion beam (2) and ion injection by orthogonal extraction device (31) from the region inside the reflector (11).
Figure 6A:
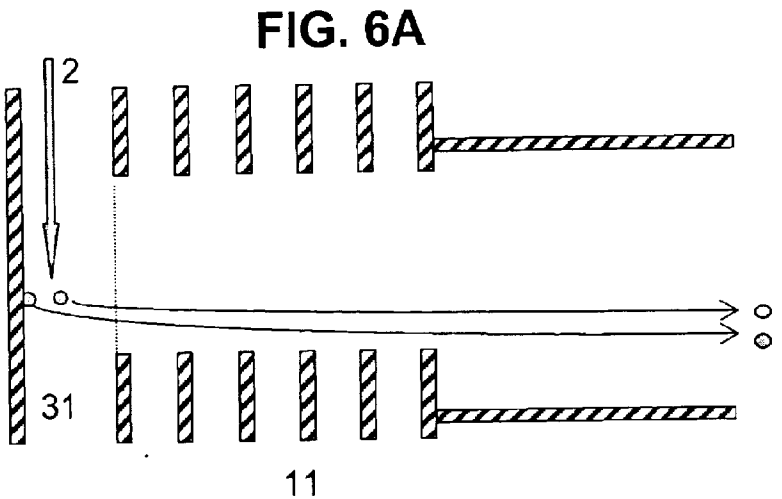
FIG. 6A. Primary ion beam (2) and ion injection by orthogonal extraction device (31) from a region behind the reflector (11).
Figure 7B:
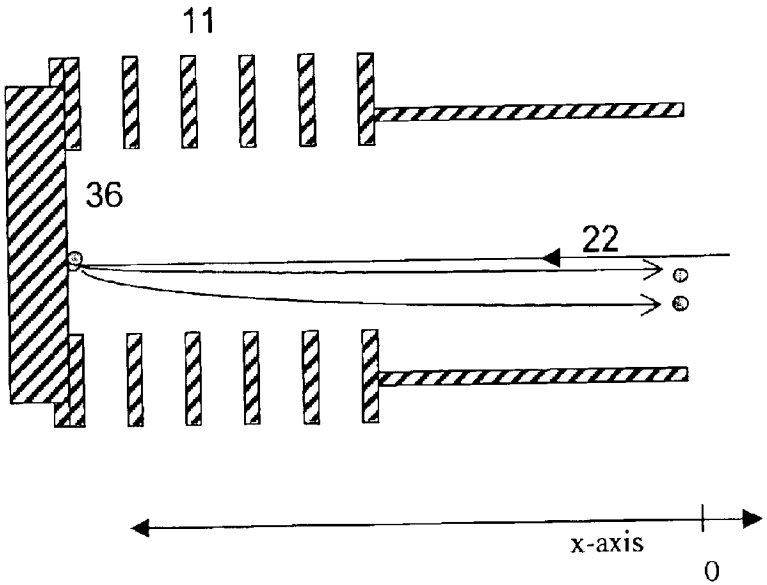
FIG. 7B. Surface ion extraction from a surface aligned with the back plate (36) of the reflector (11).
Figure 7A:
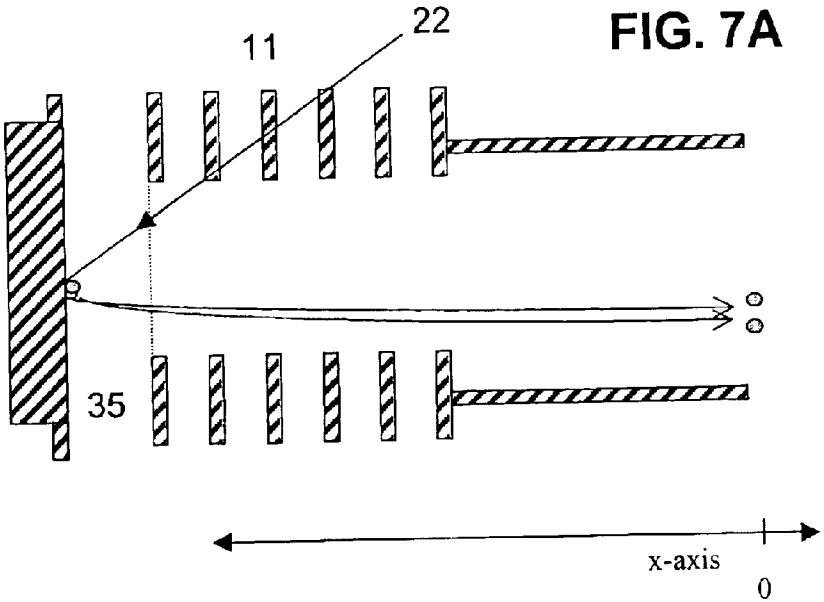
FIG. 7A. Surface ion extraction (35) from a region behind the reflector (11). A beam (22) is used for desorbing, ablating, or scattering the particles from the surface.

The device that extracts the ions into the ion trap can be external to the trap, as shown in FIG. 6A for the case of orthogonal extraction. As an alternative, it can be part of the trap as shown in FIG. 6B for the orthogonal extraction. For surface ionization methods, in-source extraction is illustrated in FIG. 7B whereas the external extraction is illustrated in FIG. 7A. In order to inject an ion population into the reflector trap with an external extraction, either the potential of one of the reflectors or the potential of the drift tube has to be altered. In a preferred embodiment, the potential of the reflector through which the ions are entering is temporarily reduced during the ion injection. As soon as the ions of interest are within the trap, the potential is increased to the normal values guaranteeing isochronous oscillations.

When using an in-trap extraction, it is sometimes possible to produce the ions within the trap. For example, it is possible to use the back plane of one of the reflectors as a surface from which the ions are produced by laser ablation or laser desorption or SIMS or any other surface ionization method. This is illustrated in FIG. 7A. With such in-trap ionization, the need to change potentials is eliminated or reduced. Compared to previous solutions, no feed-back from the detector to the entrance mirror has to be provided. One example where the need to change potentials is completely eliminated is the aerosol double trap from FIG. 11. This mass spectrometer doesn't require any changed potentials and the mirrors are fed by a voltage controller with constant DC voltages only.

Simultaneous Positive/Negative Ion Detection

Figure 11A:
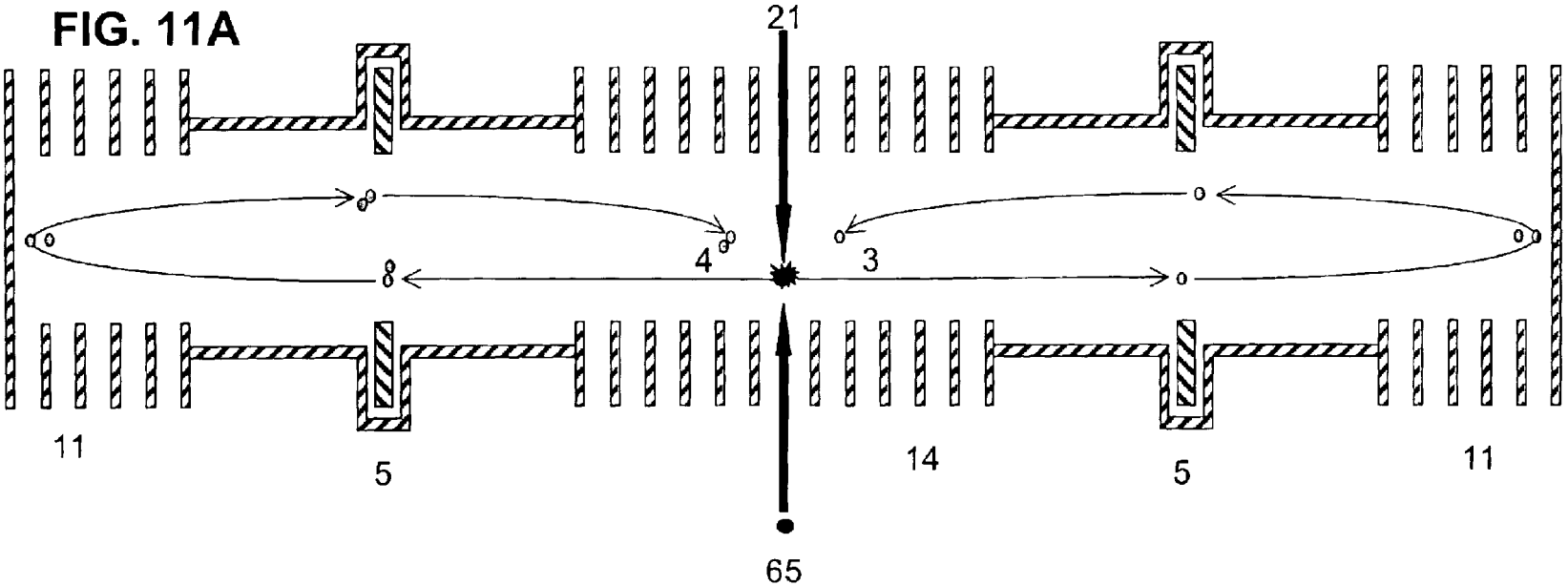
FIG. 11A. Double trap for simultaneous detection of negative ions (3) and positive ions (4) ablated from aerosol particles (65).
Figure 11B:
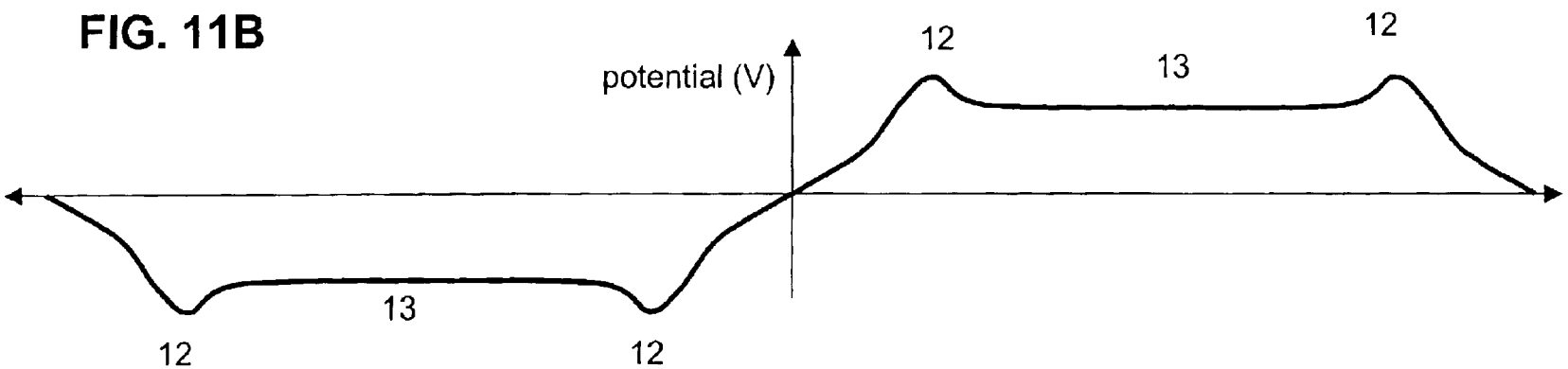
FIG. 11B. Potential slope of the double trap configuration. Accelerating lenses are used as reflector lenses (12). The double reflector (14) acts also as the ion extractor.
Figure 12A:
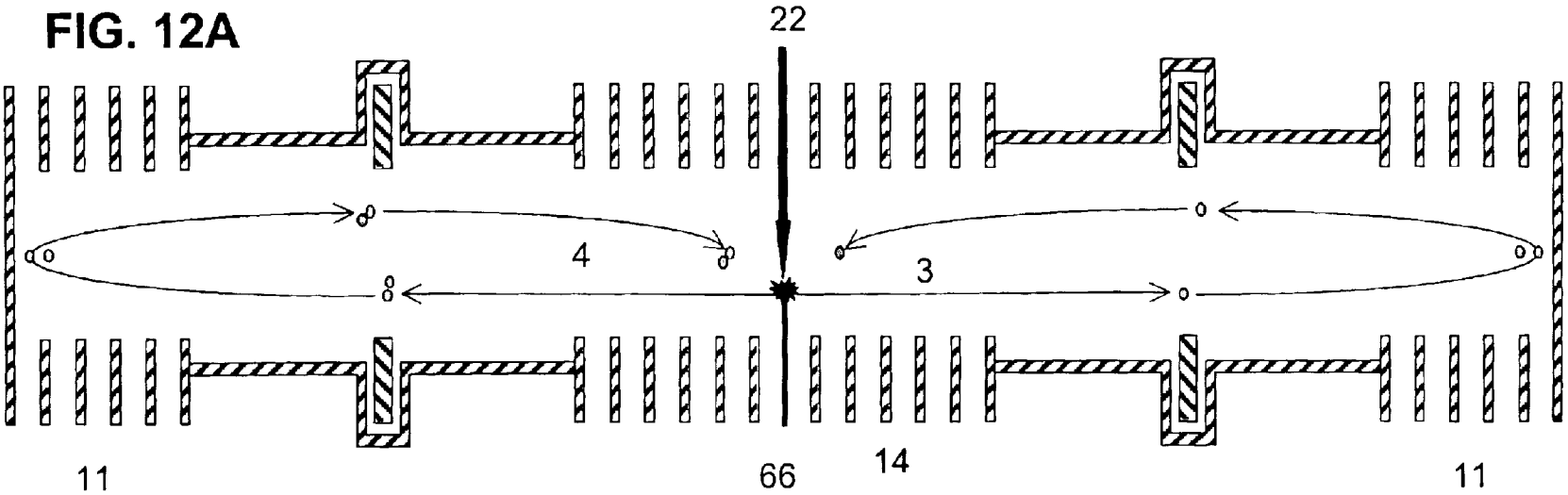
FIG. 12A. Double trap for simultaneous detection of negative (3) and positive (4) MALDI ions desorbed from a thin movable MALDI sample holder (66) holding multiple MALDI samples (67).
Figure 12B:
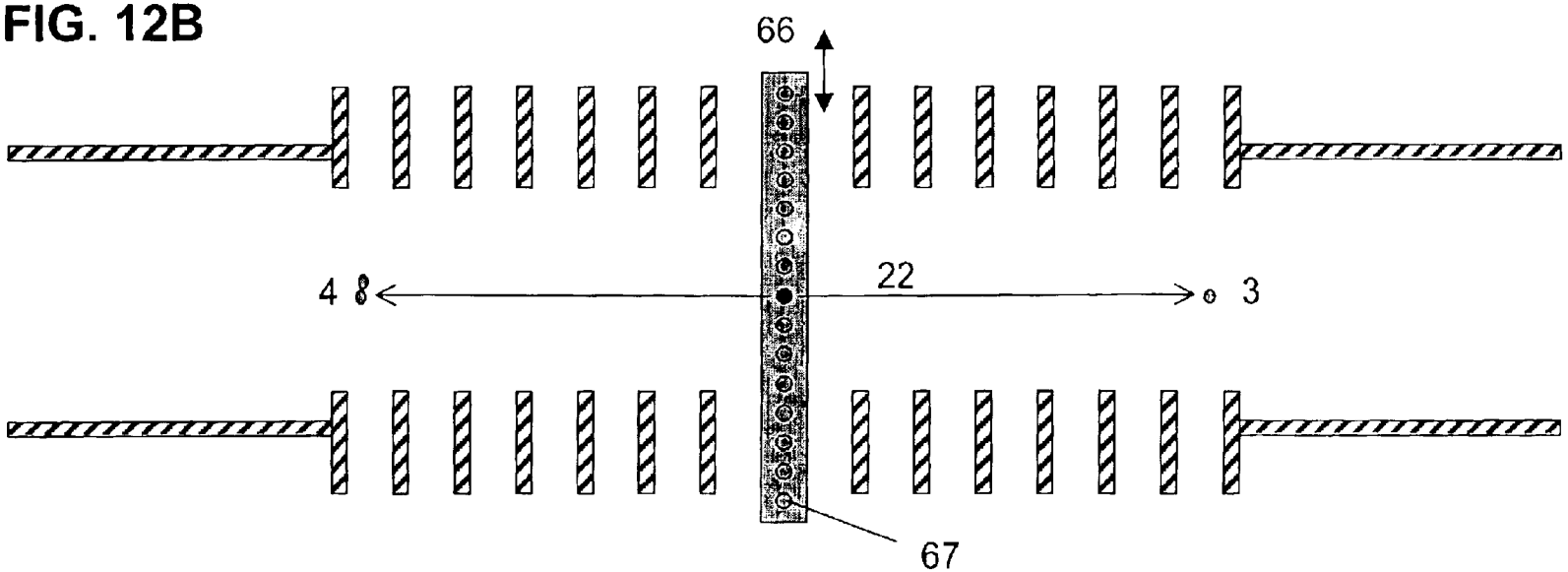
FIG. 12B. Enlarged view from the direction of the laser beam (22) of the moveable MALDI sample holder (66) of the instrument of FIG. 12A.

Some analysis applications require the simultaneous detection of positive (4) and negative (3) ions. One example of such an application is the real-time aerosol analysis, where negative and positive ions are laser ablated from an aerosol particle, whereby the aerosol particle (65) is destroyed or lost. Placing two coaxial reflector traps next to each other, as indicated in FIG. 11, positive and negative ions can be detected simultaneously. This preferred embodiment for aerosol analysis, may also be useful with surface ionization methods like SIMS (secondary ion mass spectrometry), laser ablation mass spectrometry (LA, MALDI), and other ionization methods where both, negative and positive ions are produced simultaneously. If the detection of negative and positive ions does not need to be simultaneous, it is possible to use only one trap with reversed potentials for negative and positive ions respectively. In this case, the ions of negative and positive charge are not recorded simultaneously, but sequencially. For example, after recording the transient of a positive ion analysis, the potentials are switched to opposite signs and then negative ions are injected into the trap for the next analysis. This will require more time for the analysis, but it will reduce the size of the instrument.

Orthogonal Extraction

Figure 6D:
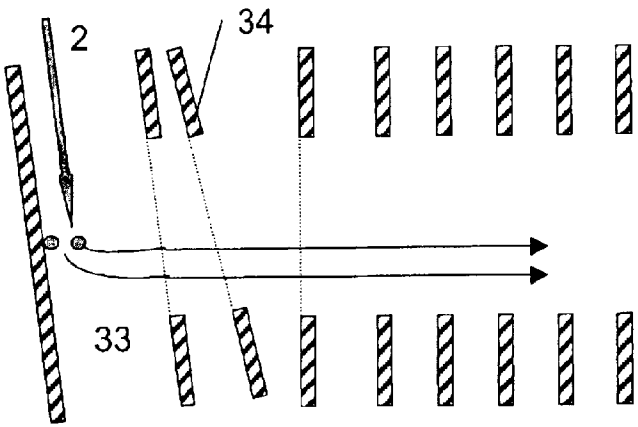
FIG. 6D. Ion injection by orthogonal extraction with tilted extractor (33) and correction grid (34) in order to compensate for the initial energy of the ions in the primary ion beam (2). The correction grid (34) is not absolutely necessary.
Figure 6C:
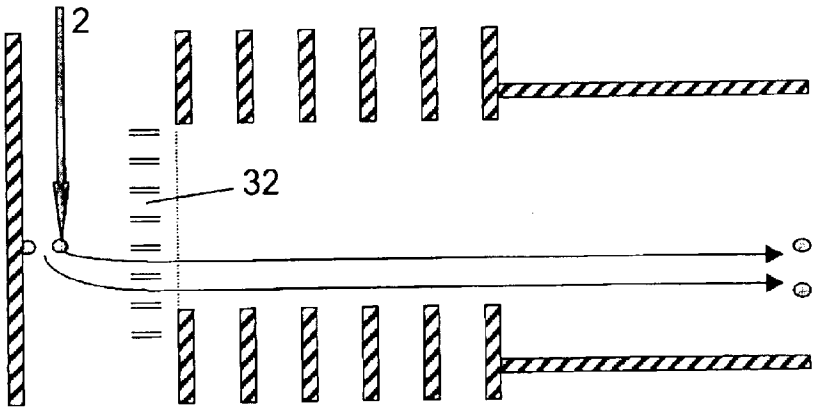
FIG. 6C. Like FIG. 6(*a*) but including a multi deflector (32) in order to compensate for the initial energy of the ions in the primary ion beam (2).

The orthogonal extraction technique has been widely used in recent years to extract ions into TOFs. The orthogonal extraction allows for smaller initial energies in the extraction direction and is hence popular with high resolution TOFs, but it is also very useful if the particle ionization can not be done in the extraction region of a TOF, e.g. in the case of electrospray ionization plasma analysis, or in combination with other spectrometers in order to perform MS/MS. For some analysis methods like ESI it will therefore be favorable to use orthogonal extraction in combination with the electrostatic trap. One method to accomplish this is the use of the multi-deflectors (32) as developed by Melvin Park (see Melvin Park et al., Bruker Daltonics, 46th ASMS Conference Orlando. Florida (1998) p. 883) or the quadrupole lenses developed by Bergmann (T. Bergmann et al. Rev. Sci. Instum. 61/10 (1990) p. 2585). The multi deflector extraction in combination with a reflector trap is indicated in FIG. 6C. Another possibility is the use of an extraction directly in the reflector without compensation of the initial energy orthogonal to the trap axis, as illustrated in FIGS. 6A and 6B. This technique makes use of the fact that a gridless reflector can be used as a gridless extractor with the ability to refocus to some degree velocities orthogonal to the reflectron-axis. Gridless reflectors include a so-called reflector lens (12) at the transition of the reflector and the fieldless drift (13). This reflector lens is used to focus the ions and account for the defocusing effect of a gridless reflector. This focusing reflector lens introduces some velocity component orthogonal to the x-axis for the non-axial ions. Hence, such a reflector is able to tolerate, to a small degree, such velocities orthogonal to the reflectron-axis. This tolerance for initial energies may be increased by temporarily changing the reflector lens voltage. A further way to accomplish for the initial energies of an orthogonal extraction is tilting the extraction chamber (33) for just the right angle to compensate the initial energy as indicated in FIG. 6D. This Figure also contains a second grid (34), which is tilted for an even larger angle for correction of the particle front.

Figure 7C:
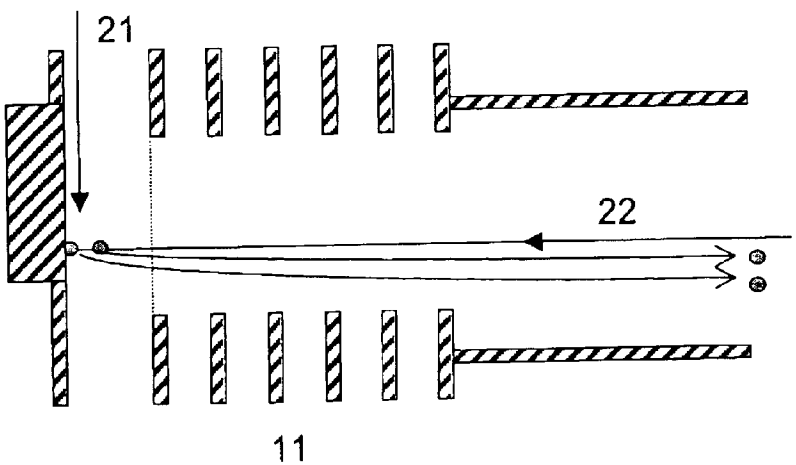
FIG. 7C. Ion injection by surface ion extraction with separate ionization beam (21).

The reflectron trap is especially well suited for surface desorption methods (MALDI, LIMS, SIMS). In this case, the surface from which the analyte particles are desorbed, is either placed behind the reflectron (FIGS. 7A and 7C) or at the back plate of the reflectron (FIG. 7B). In both cases, a delayed extraction scheme is preferable but not essential. In both cases, the desorbing beam does not have to be the ionizing beam. In FIG. 7C the ionizing beam is a separate beam with orthogonal incidence.

Figure 8B:
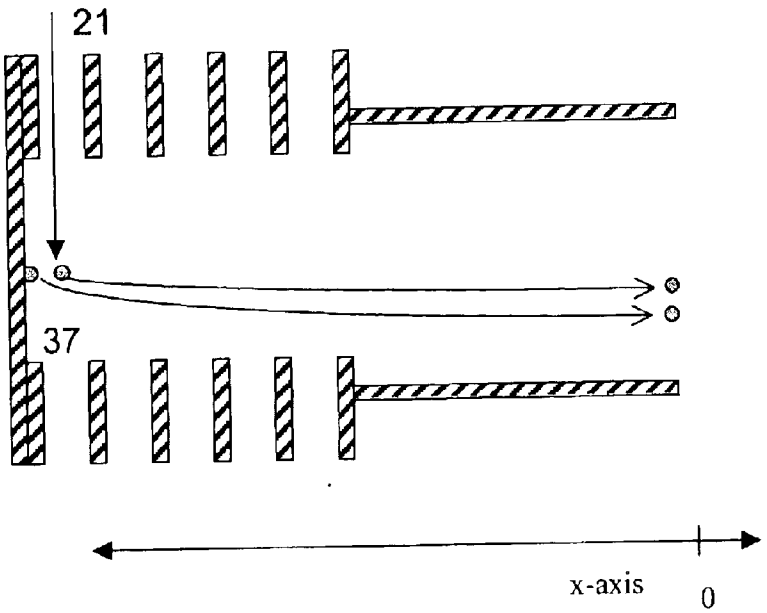
FIG. 8B. As FIG. 8A but the ions are produced and extracted from a volume (37) inside the reflector.
Figure 8A:
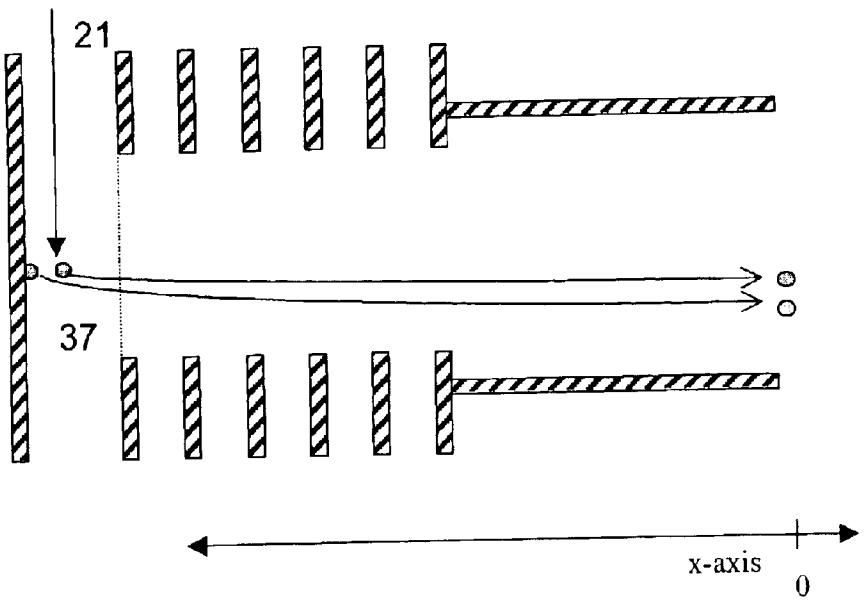
FIG. 8A. Ion injection from a region outside the reflector (11) by extracting from a volume. The ions are produced in this volume (37) by an ionizing beam, e.g. a laser beam, an electron beam, an ion beam, or a metastable atom beam (21).

In this analysis, the ions are not created from a surface but from a volume on the axis of the reflectrons. Ionization methods include the storage source where ions are stored in the attractive potential of an electron beam (see Wollnik et al., 48$^{th}$ ASMS Conference, Long Beach, Calif. (2000)). Again, the ionization can take place inside or outside the reflectron (see FIGS. 8A and 8B).

Figure 13A:
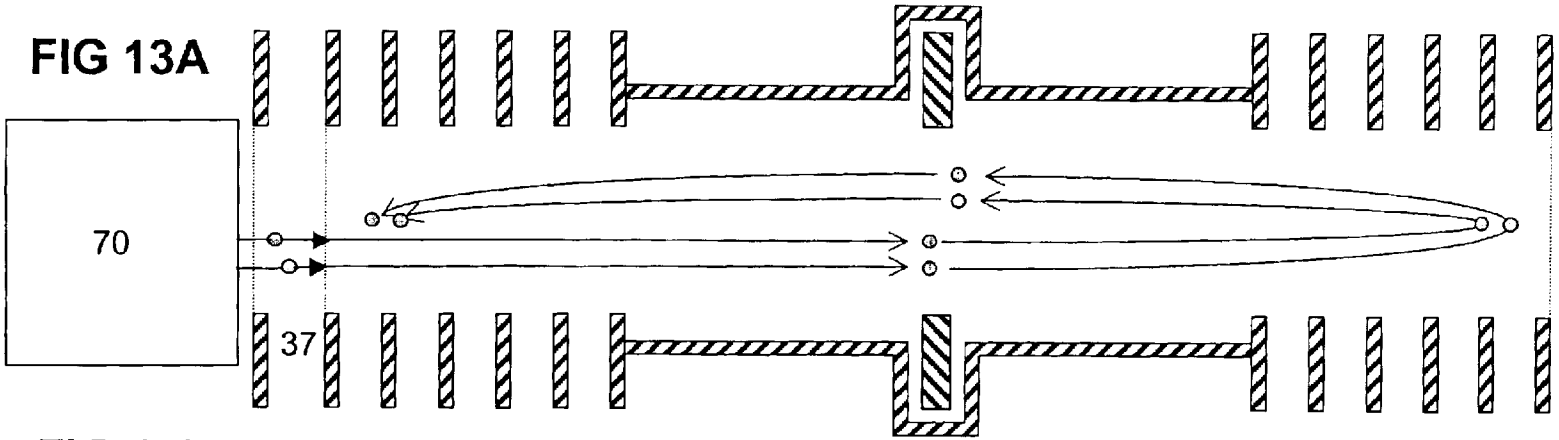
FIG. 13A. A reflector trap with a rf ion trap (70) for ion accumulation, ion storage or ion pre-selection. The ions are injected from the rf ion trap into the reflectron trap with an extractor (37) similar as the ones discussed in FIG. 8.

MS/MS includes the processes of selecting and isolating an ion specie from the original ion population, then fragmenting these parent ions, then analyzing the fragment ions. There are several options to do MS/MS: The pre-selection process is done in a separate apparatus, e.g. a conventional rf ion trap (e.g. 3D quadrupole trap or Paul trap, cylindrical ion trap (CIT), linear quadrupole trap), a TOF, or a mobility mass spectrometer. These pre-selected ions (parent ions) are then fragmented and analyzed in the reflectron trap. Such a device is illustrated in FIG. 13A. FIG. 10B illustrates a similar combination, consisting of a first TOF with MALDI source (35), a parent ion selection ion gate (60), a gas collision cell (61) for ion fragmentation, and the FRT for the fragment analysis (11).

Alternatively, the parent ion selection and isolation process, the fragmentation process and the analysis of the fragment ions can all be done in the reflectron trap. For this case, the parent ion pre-selection process and the fragmentation process is discussed in more detail in the following sections.

In-Trap Ion Selection/Isolation

In order to do MS/MS it is useful to isolate one (or sometimes several species) in the trap. This means that all unwanted ions have to be removed from the trap while the wanted ions (parent ions) are to stay in the trap. This can be achieved by temporally applying potential pulses to some of the electrodes of the trap. All ions at that time close to those electrodes will occur distortions of their oscillating orbits and will eventually get lost by exiting the trap or by hitting an electrode.

For example, by sufficiently changing the potential of one of the reflectrons, all ions within this reflectron will get lost, whereas the ions which are at that time in the other reflectron or in the drift tube, will survive. In a more preferred embodiment an ion deflector 17 inside the trap can be used to eliminate unwanted ions. By repeating this procedure several times, it is possible to isolate a single specie of ions, getting rid of most other ion species.

Figure 16:
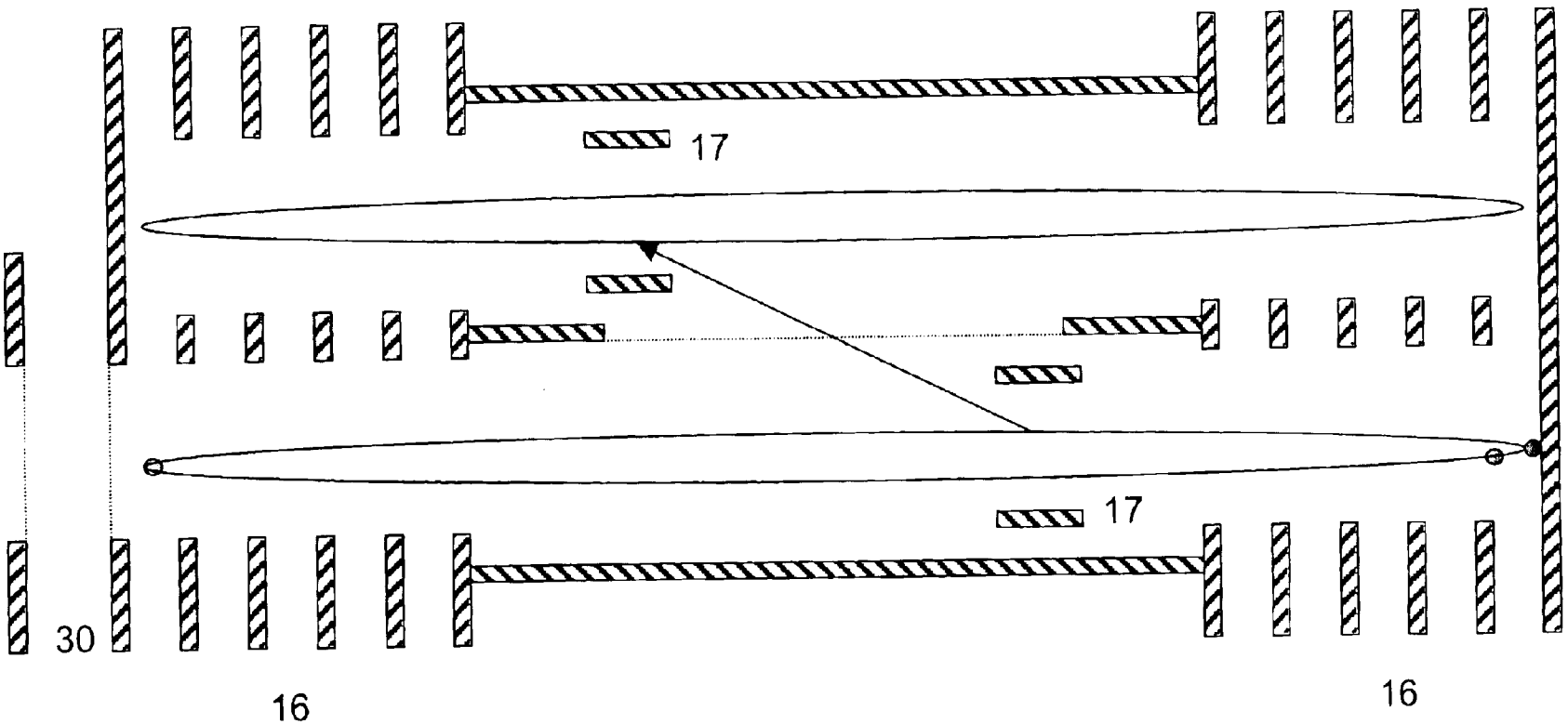
FIG. 16. A FRT-FRT combination where a pulsed ion deflector (17) is used to inject and isolate an ion specie into the upper FRT. In the upper FRT, some fragmentation method of FIG. 9 would be applicable.

Another embodiment is illustrated in FIG. 16, where deflectors 17 inside the FRT are used to select parent ions by transferring them into an adjacent FRT, where they can be fragmented and analyzed. It is even possible to do MS$^n$ by repetitively selecting fragments into the adjacent FRT. Fragmentation is done by processes illustrated in FIG. 9. The device in FIG. 16 would be called FRT/FRT.

Figure 10A:
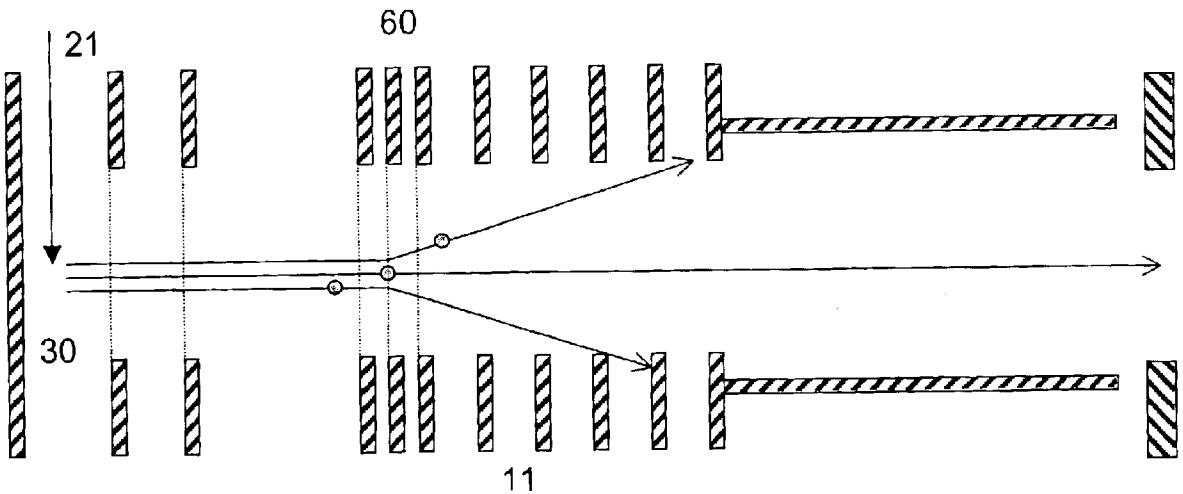
FIG. 10A. Parent ion selection with a pulsed ion gate (60) prior to the ion injection. There are several types of pulsed ion gates described in the literature. This one includes a wire grid with two independent sets of wires on different potential. Hence ions are deflected. By applying equal potential to both wires for a short time, a small range of masses can be allowed through the gate without being deflected.
Figure 10B:
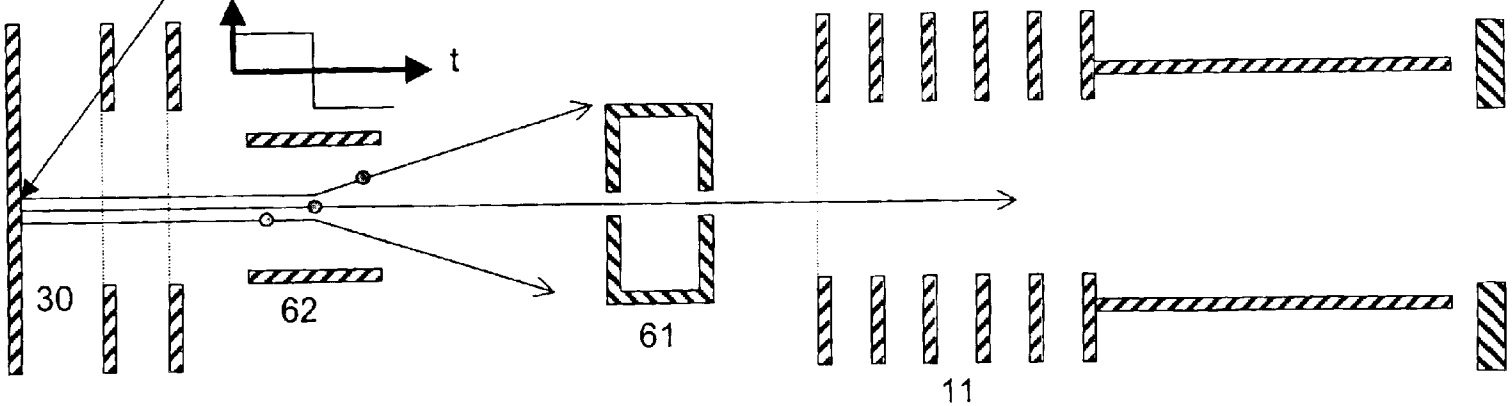
FIG. 10B. Parent ion selection with a pulsed ion gate (60) and a gas collision cell (61) for CID (collision induced dissociation) at elevated gas pressure for parent ion fragmentation prior to the ion injection in to the first reflectron (11), where ions are accelerated a second time to much higher energies in order to reduce the relative energy difference among the ions.

Another embodiment for ion selection is the use of an ion gate (60) prior to the injection into the FRT as indicated in FIG. 10. Several types of ion gates are described in literature. FIG. 10A illustrates a wire gate 60 where a wire grid with two independent set of wires on different potential are used to deflect ions passing through the gate. To allow a parent ion into the first reflectron (11) the two wire sets are set to the same potential for a short time. This will allow the parent ion of choice to pass the gate undeflected. Two additional wire grids in front and after the selecting grid minimize the length of the field distortion.

A second type of ion gate is illustrated in FIG. 10B where the polarity of a deflector 62 is reversed exactly at the moment when the parent ion of choice is in the center of the deflector. This will "bend back" the trajectory of this ion, hence allowing it to keep the initial direction (with a small offset, which is not shown). Other ions are deflected and lost.

Figure 15:
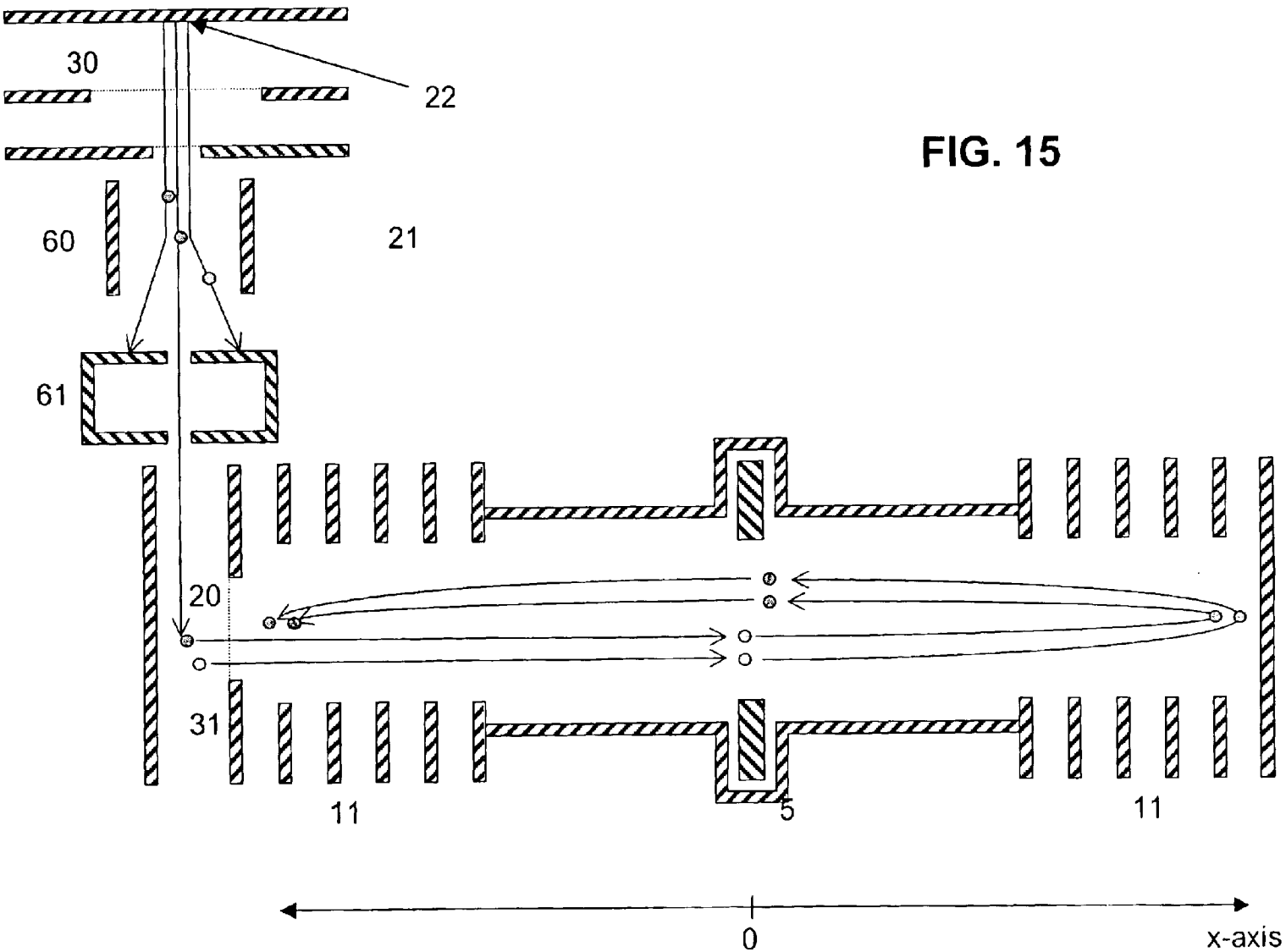
FIG. 15. A TOFIFRT similar to FIG. 10B but with orthogonal extraction into the FRT.

Another preferred embodiment is illustrated in FIG. 15, where a linear TOF combined with an ion gate 60 is used for parent ion selection. Selected parent ions are fragmented in the fragmentation device 61 for example by gas collisions, electron attachment, electron impact, or any other state of the art fragmentation mechanism. Then the fragment ions are transferred into the FRT by orthogonal extraction 31. The first MS does not need to be a linear TOF, it can also be a single or multiple reflection TOF.

Other types of ion gates based on one or several deflectors exist. Ion gates based on deflectors can also be installed within the FRT (as indicated with 17 on FIG. 16) in order to do repeated ion selection/isolation processes. Such repeated ion selection/isolation is required for MS$^n$, which will be described in a later section.

Ion Soft Landing

After ion identification, it is possible to selectively soft land ions onto the reflectron back plate or another plate outside the reflectron. Because of the large flight times in the FRT, ions of only a small m/z difference will be sufficiently separated in time and space so that the electrostatic field in the FRT can be temporarily changed in order to soft-land a specific specie. Alternatively, an ion selection/isolation process as described above can be performed and all ions remaining in the trap can be soft-landed. Instead of soft landing on a surface, the ion can be used for other processes or purposes. It is one advantage of the FRT compared to the conventional TOFs that the detection by FRT is non-destructive and ions can be further used after their m/z identification.

Single Ion Detection

Due to the good sensitivity it is possible to use the FRT for "single ion detection" where very small amount of samples are used to produce very few ions which have to be identified with high resolving power. This opens the possibility to make a high resolving atom probe.

Combination of Analysis Methods

Figure 13B:
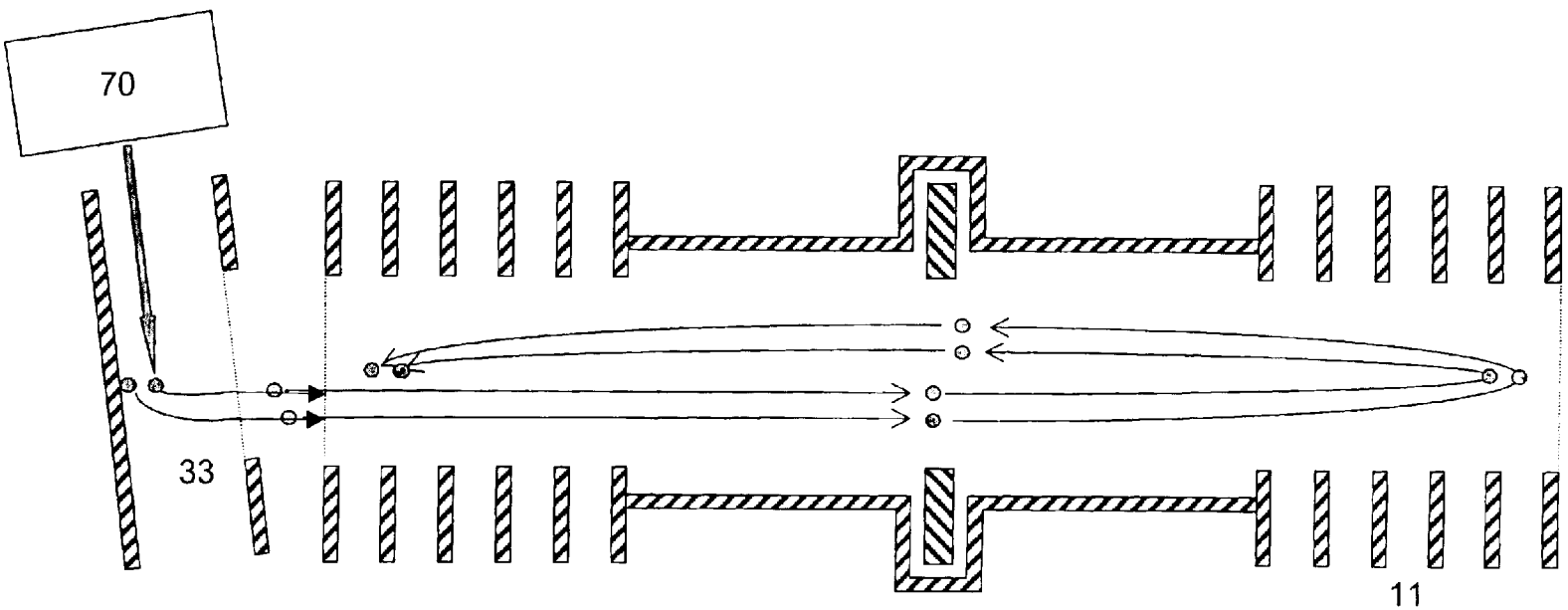
FIG. 13B. Same as FIG. 13A, but the ions are injected from the rf ion trap (70) into the reflectron trap with an orthogonal extractor (33) discussed in FIG. 6.

Often it is desirable to combine several analytical methods in order to increase the detection limits of the overall analysis. Examples of such combinations are: GC-MS, LC-MS, SFC-MS (supercritical fluid chromatography), Mobility-MS, CE-MS (capillary electrophoresis), MS-MS. All those combinations are doable with the FRT as the MS. FIG. 13 illustrates the combination of a primary analysis method (70) with a FRT. FIG. 13A illustrates a co-axial coupling using a coaxial injection (37) and FIG. 13B illustrates an orthogonal coupling using an orthogonal extraction (33).

One special configuration is worth mentioning, the TOF-FRT combination, where a TOF is used to pre-select and focus the ion species injected into the FRT. The time-focused injection discussed earlier is in fact a TOF-FRT combination where the TOF is used to time-focus the ions in the center of the FRT. FIG. 10 illustrates a TOF-FRT combination which additionally includes a wire gate (60) to selectively allow ion species into the FRT. The TOF accelerates the ions from the TOF extraction chamber (30) towards the center of the FRT (0). The wire gate (60) allows only a selected range of species into the trap, whereas other species are defocused and dispersed.

Combinations of analytical methods can be used for fragment analysis when some dissociation method is included. Such instruments, based on the FRT are discussed in the following sections.

Parent Ion Dissociation

In order to do MS/MS, the isolated parent ions have to be fragmented or dissociated. Ion dissociation can be done outside the trap, as illustrated in FIG. 10*b* for the case of CID (collision induced dissociation), or inside the trap as illustrated in FIG. 9.

A preferable position for in-trap fragmentation is the turning point in either reflectron because (a) the ions are slow, and (b) the fragments will have the same energy as the parent ion, which is the energy appropriate to continue the oscillation in the trap. FIG. 9A presents the dissociation (50) of a parent ion (55) at the turning point in the reflectron using a dissociating beam (51) as for example a particle beam, ion beam, electron beam, laser beam, or a photon beam.

Figure 9B:
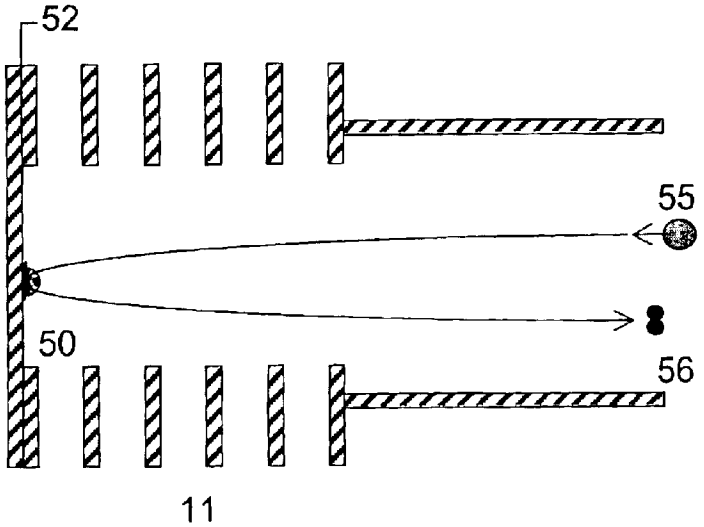
FIG. 9B. Surface induced dissociation and fragmentation (50) of the parent ion (55) at the back plate (52) of the reflectron (11).
Figure 9A:
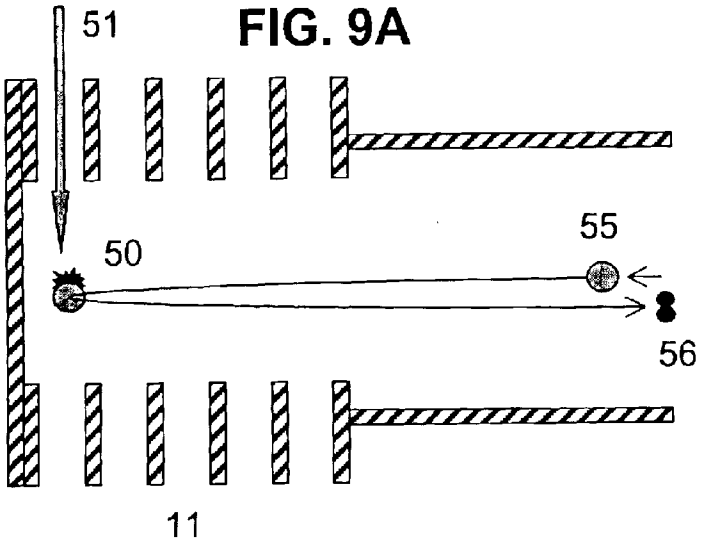
FIG. 9A. Dissociation and fragmentation (50) of the parent ion (55) at the turning point with a dissociating beam (51). The dissociating beam (51) may be a laser beam, a light beam, an electron beam, an ion beam, or a metastable atom beam or another beam suitable for ion fragmentation. The fragment ions (56) are also called daughter ions.

FIG. 9B presents the surface induced dissociation (SID) of the parent ion (55) on the back plate (52) of one of the reflectrons. For this method some of the reflectron electrode potentials are temporarily decreased in order to allow the parent ion (55) to impact onto the back plate of the reflectron surface which will lead to dissociation (50).

Figure 9C:
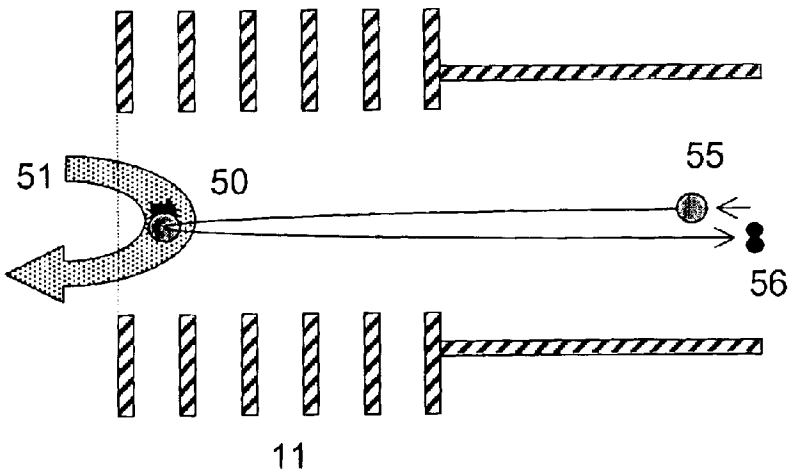
FIG. 9C. Dissociation by a flood of low energetic electrons (51) entering the reflectron (11) through a grid in the reflectron back plate.

FIG. 9C illustrates another preferred embodiment for ion dissociation. Here, a flood of low energetic electrons (51) enters the reflectron (11) through a grid in the reflectron back plate in order to dissociate (50) the parent ion (55). This method of ion fragmentation is often referred to as EIEIO (electron impact excitation of ions from organics) or EID (electron induced dissociation).

Dissociation may be done during only one passage of the parent ions or it may be done repetitively during several passages of ions through the turning point region. Using several passages allows for increased dissociation probabilities, or use of several different fragmentation methods.

If the FRT is combined with another MS, or with any other separation method, fragmentation can be done outside the trap. This is illustrated in FIG. 10B for the case of a TOF-FRT combination with a fragmentation mechanism (61), in this case a collision cell, between the two instruments. According to our nomenclature, such a combination would be referred to as TOF/FRT where the slash indicates the intermediate fragmentation. Of course, the order of the separation method can also be reversed, which results in an FRT/TOF where the FRT is used for parent ion selection and the TOF is used for fragment analysis. Such a configuration would have the advantage that the faster analysis time scale of the TOF would allow analyzing several parent ions successively.

$MS^n$

Figure 14A:
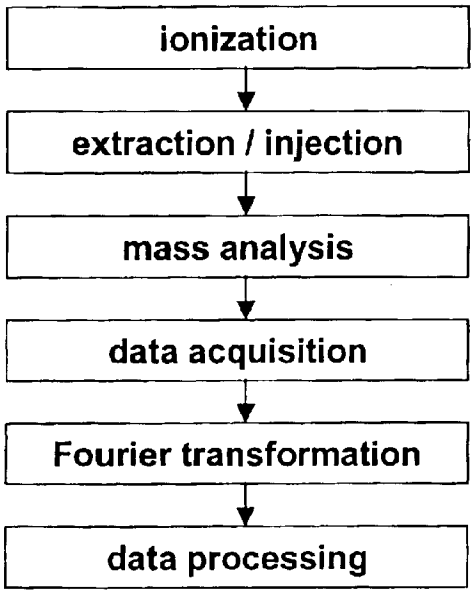
FIG. 14. Illustration and comparison of the processes required for simple MS analysis, MS/MS analysis and $MS^n$ analysis with a reflectron trap.
Figure 14B:
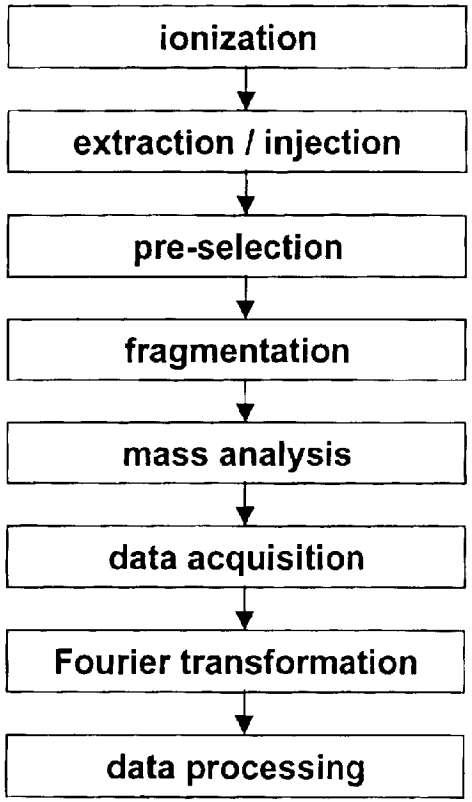
Figure 14C:
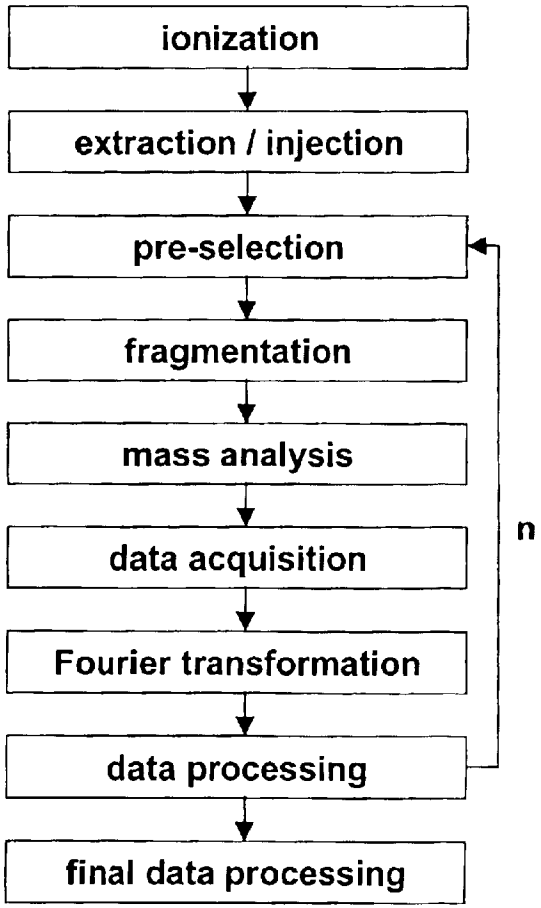

By applying the parent ion selection process and the fragmentation process several times it is possible to do $MS^n$, as it is well known in quadrupole ion traps. A comparison of the processes for doing MS, MS/MS and $MS^n$ is illustrated in FIG. 14.

Q/FRT

Another way to do MS/MS is the use of an additional linear quadrupole analyzer 70 for the parent ion selection, as it is widely done in combination with orthogonal extracting TOFs. In one preferred embodiment the parent ion selecting linear quadrupole is followed by a dissociation quadrupole where fragments are produced from the parent ions. Afterwards the fragments and remaining parent ions are injected into the FRT with either an orthogonal extraction (as in FIG. 13B) or with a coaxial injection (FIG. 13A). The coaxial injection introduces larger time errors, but those can be compensated for with more oscillations in the FRT. This coaxial injection is explained in more detail below. In another preferred embodiment the parent ion isolation and fragmentation steps occur in the same linear quadrupole analyzer.

IT/FRT

Another preferred embodiment would use a rf ion trap (IT) 70 for parent ion selection, storage and fragmentation. The IT 70 can be a 3D quadrupole trap (also called Paul trap), a cylindrical ion trap (CIT), or a linear quadrupole trap (LQT). An orthogonal (FIG. 13B) or coaxial (FIG. 13A) extraction into the FRT would then allow for high resolution mass analysis of the fragments. The FRT can also be used for ion accumulation in order to increase the size of the ion population prior to the injection into the FRT. The same can be achieved with a multi-pole trap. These configurations are illustrated in FIG. 13 where (70) denotes the IT.

The combination of a Paul trap with a TOF exists since a long time and was first done by Lubman. However, the combination of a ion trap or a linear quadrupole with an electrostatic ion trap is novel.

Coaxial Ion Injection from Quadrupoles or Quadrupole Ion Traps

Figure 17A:
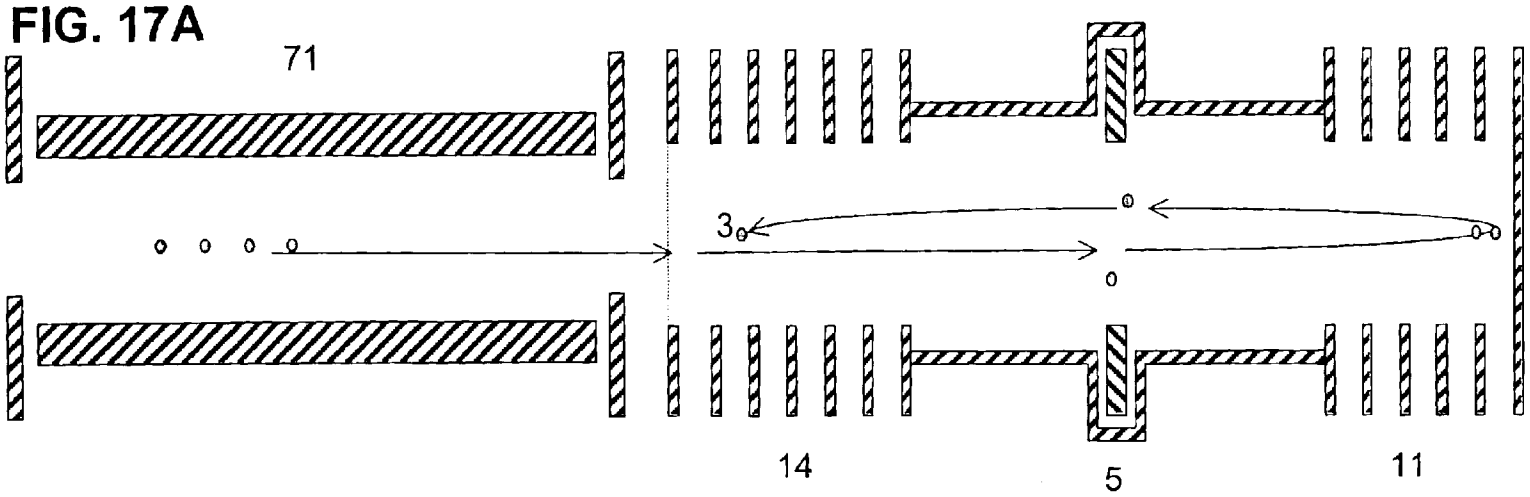
FIG. 17A indicates the schematic hardware and FIG. 17B indicates the filed potential during storage (72) and ion extraction (73).
Figure 17B:
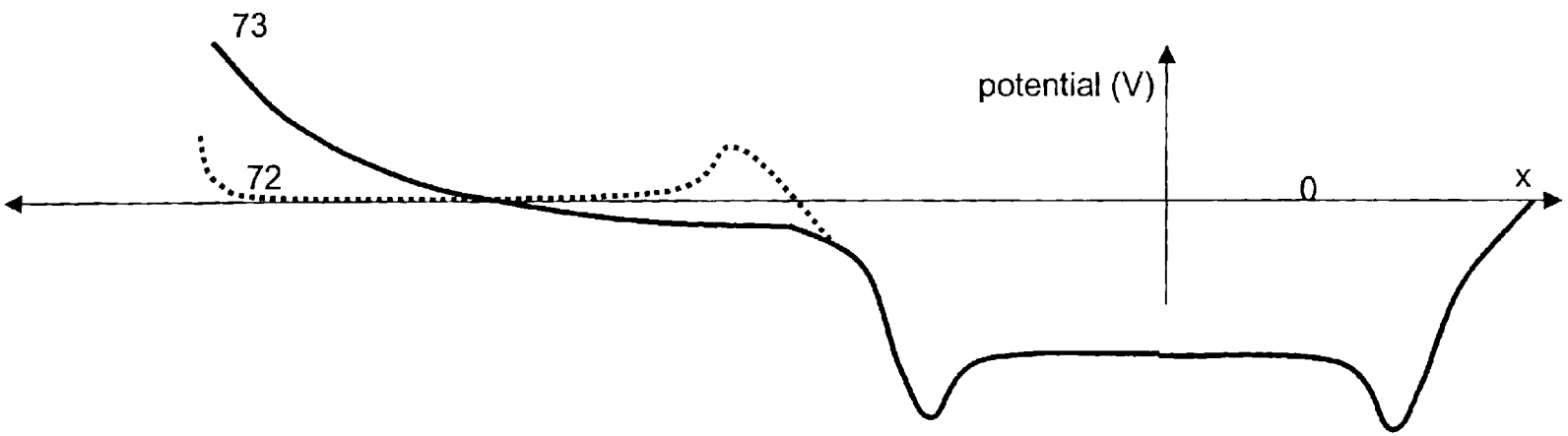
FIG. 17. A linear quadrupole-FRT combination where the extraction field 73 extracts ions from the linear quadrupole 71 in a way that the ion distribution has a time focus in the center 0 of the FRT.

When using a coaxial extraction from an external linear rf quad rupole (FIG. 17) into the FRT, an extraction field along the quadrupole axis will help keeping the special and temporal distribution of the extracted ions low. Quadrupoles (71) with imposed coaxial fields are state of the art. In a preferred embodiment the imposed coaxial field components results in an ion time focusing in the center 0 of the FRT. This is achieved with a predetermined potential along the axis direction 73, which results in a simultaneous arrival of all ions extracted from the linear quad rupole. The shape of this potential depends on many parameters like the length and potential in the FRT, the length of the linear quad rupole 71, and the distance between the quad rupole 71 and the FRT. The shape of the field has to be evaluated with numerical procedures.

When operating the linear quad 71 as an ion trap 70, the initial superimposed field 72 would be a trapping field with potential wells on both ends of the trap. When parent ion selection, isolation and fragmentation is done, the trapping field 72 would be quickly changed into the extracting field 73 in order to time-focus the ions in the center 0 of the FRT. This process is similar to the time focusing in a linear TOF. The required extraction field 73 could be approximated with a linear field, as it is usually done in liner TOFs.

IMS/FRT

Another preferred embodiment would use an ion mobility spectrometer (IMS) for parent ion selection. After the IMS, the parent ions are fragmented. An orthogonal or in-axis extraction into the FRT would then allow for high resolution mass analysis of the fragments. The IMS can also be used with an additional ion trap for ion accumulation in order to increase the ion population prior to the injection into the reflectron trap. The same can be achieved with a storage multi-pole.

All those combinations mentioned above can also be operated without the fragmentation. In this case, the pre selection is used to prevent unwanted ions to enter the second stage instrument (in this case the FRT) in order to obtain lower detection limits.

What is claimed is:

1. An electrostatic ion trap apparatus for mass analysis or mass separation of a population of ions comprising:

means to generate ions or means to introduce existing ions into said apparatus;

two opposing ion reflectors and a drift region that provide an electric field in which said ions make isochronous oscillations;

a voltage supply for feeding the ion reflectors with constant DC voltages;

sensing means for sensing a transient of said oscillations;

a data acquisition system capable of producing a mass spectrum by transforming said oscillation transient; and an ion injection mechanism to inject said ions into said trap, wherein said ion injection mechanism comprises a pulsed ion injector device that injects said ions into said trap with a pulsed electric field in such a way that said ions are time-focused in a center region of said trap generally corresponding to a position of said sensing means.

2. The electrostatic ion trap of claim 1 wherein said sensing means include a ring-shaped pick-up electrode.

3. The electrostatic ion trap of claim 1 wherein said sensing means include a tube-shaped pick-up electrode.

4. The electrostatic ion trap of claim 1 wherein said sensing means includes at least one of the following:

a ring-shaped pick-up electrode;

a tube-shaped pick-up electrode;

a coil for inductively sensing the transient.

5. The electrostatic ion trap of claim 1 wherein said data acquisition system includes means for Fourier transformation and/or wavelet formation of said transient into a frequency spectrum and a mass spectrum.

6. The electrostatic ion trap of claim 1 wherein said sensing means comprise a first pick-up electrode and a second pick-up electrode whereby a differential voltage between said first and second pick-up electrodes is used as said transient.

7. The electrostatic ion trap of claim 6 wherein said first pick-up electrode and said second pick-up electrode are caps, the first pick-up electrode coupled to a first of said ion reflectors and the second pick-up electrode coupled to another of said ion-reflectors.

8. The electrostatic ion trap of claim 7 wherein said ion reflectors are constituted by a plurality of electrostatic elements whereby the elements of each of said reflectors are high-frequency coupled.

9. The electrostatic ion trap of claim 1 wherein one of said ion reflectors is a hard mirror which does not significantly contribute to the isochronity of said ion trap.

10. The apparatus of claim 1 which includes a second electrostatic ion trap which is aligned essentially co-axially with said first electrostatic ion trap in order to allow simultaneous analysis of positively charged and negatively charged ions of said ion population.

11. The electrostatic ion trap of claim 1 further comprising an ion detector in order to run said apparatus in a dual mode, one mode being the transient sensing mode and another mode being a time-of-flight mode using said detector.

12. The electrostatic ion trap of claim 1 wherein said injector device comprises an extraction device that is located within one of said reflectors.

13. The electrostatic ion trap of claim 1 wherein said injector device comprises an orthogonal extractor.

14. The electrostatic ion trap of claim 13 wherein said orthogonal extractor is part of a gridless reflector.

15. The electrostatic ion trap of claim 13 that contains ion optical means so as to compensate for initial ion energies prior to the orthogonal extraction.

16. The electrostatic ion trap of claim 15 wherein said optical means include one or a combination of the following elements:

a reflector lens potential that is adjusted according to a predetermined sequence;

a single deflector;

a multi-deflector;

a quadrupole correction lens;

a tilted orthogonal extractor;

a tilted correction grids after the orthogonal extractor.

17. The electrostatic ion trap of claim 1 wherein said ion injector device is capable of generating an ionizing beam for producing ions from a surface being essentially a backplate of one of said ion reflectors.

18. The electrostatic ion trap of claim 1 wherein said injector device is capable of generating a first beam for desorption/ablation and a second beam for ionization of said ions.

19. The electrostatic ion trap of claim 1 wherein said ion injector device is incorporated in one of said ion reflectors.

20. The electrostatic ion trap of claim 1, which is coupled to a primary separation apparatus in order to do ion fragmentation analysis or two-dimensional separations, wherein the primary separation apparatus is one of the following:

a general mass spectrometer for fragment analysis, known as MS/MS;

a mobility spectrometer for 2D separation or fragment analysis;

a gas chromatograph for 2D separation;

a liquid chromatograph for 2D separation;

a supercritical fluid chromatograph for 2D separation; or a capillary electrophoresis device for 2D separation.

21. The electrostatic ion trap of claim 1 including a device for isolating one or several species of ions in the trap by changing the potential of one or several electrodes at least once for a certain time span causing changes in the trajectory of one or several species of ions that are flying close to the one or several electrodes, where said changes lead to an unstable orbit of selected ions in such a way that said selected ions exit the trap or hit an electrode of the trap and get lost.

22. The electrostatic ion trap of claim 21 whereby said electrodes are part of said ion reflectors.

23. The electrostatic ion trap of claim 1 further comprising a pulsed ion gate to pre-select ions from said ion population and allow only the pre-selected ions into said trap.

24. The electrostatic ion trap of claim 23, further comprising a fragmentation device to fragment said pre-selected ions into fragment ions, in order to perform a tandem MS/MS analysis in a single ion trap.

25. The electrostatic ion trap of claim 24 wherein said fragmentation occurs in a turning point of said oscillations in either of said reflectors, wherein said fragmentation is caused by surface induced fragmentation (SID) or beam induced fragmentation.

26. The electrostatic ion trap of claim 1 further comprising ion optical means for extracting ions from their oscillating orbit and soft-landing them onto a surface for further use.

27. The electrostatic ion trap of claim 1 further comprising ion optical means for extracting ions from their oscillating orbit and injecting them into a second ion trap for further processing.

28. The electrostatic ion trap of claim 24 wherein said fragmentation means comprise a beam generator for generating a beam, in particular a laser beam, a light beam, an electron beam, an ion beam or a metastable atom beam, and for directing said beam onto a selected ion to be fragmented.

29. The electrostatic ion trap of claim 24 wherein said fragmentation device is arranged at a back plate of one of said ion reflectors.

30. The apparatus of claim 1 wherein said quadrupole comprises means for alternately generating a trapping field with potential wells on both ends of the quadrupole and an extracting field for extracting said ions and time-focusing the extracted ions in the center of the ion trap.

31. The electrostatic ion trap of claim 1 whereby the means to generate ions or to introduce existing ions into said apparatus comprise an extraction chamber and whereby the ion injection mechanism comprises:

a Time-of-Flight (TOF) mass spectrometer for preselecting and focussing said ions, whereby said TOF mass spectrometer accelerates said ions from said extraction chamber towards a center of said trap.

32. The electrostatic ion trap of claim 31 further comprising an ion gate arranged between said TOF mass spectrometer and said trap for allowing only a selected range of ion species into said trap, whereas other species are defocused and dispersed.

33. The electrostatic ion trap of claim 13 wherein said orthogonal extractor is arranged adjacent to one of said ion reflectors and wherein said orthogonal extractor is tilted with respect to said ion reflector so as to compensate for initial ion energies prior to the orthogonal extraction.

34. The electrostatic ion trap of claim 1 wherein a further ion trap is coupled to the electrostatic ion trap, whereby ions are extracted from said further ion trap and injected into the electrostatic ion trap.

35. The electrostatic ion trap of claim 34 wherein said further ion trap is coaxially coupled to the electrostatic ion trap.

36. The electrostatic ion trap of claim 34 wherein said further ion trap is orthogonally coupled to the electrostatic ion trap.

37. The electrostatic ion trap of claim 34 wherein said further ion trap is a 3D radio-frequency ion trap.

38. The electrostatic ion trap of claim 37 wherein said further ion trap is a linear radio-frequency quadrupole ion trap, whereby said ions are extracted from said quadrupole ion trap into the electrostatic ion trap using an extraction field along an axis of said quadrupole ion trap such that a low spatial and temporal distribution of the extracted ions is achieved.

39. The apparatus of claim 37 wherein said 3D radio-frequency ion trap comprises means for generating a field for parent ion selection, where ions of a preselected mass region stay inside the trap whereas ions of remaining mass regions are ejected from the trap.

40. The electrostatic ion trap of claim 1, further comprising:

a fragmentation device to fragment pre-selected ions into fragment ions, in order to perform a tandem MS/MS analysis, wherein said fragmentation device comprises an electron generator for generating low energetic electrons and a grid arranged in a back plate of one of said ion reflectors, whereby said electron generator is arranged such that said low energetic electrons enter said ion reflector through said grid.

41. The electrostatic ion trap of claim 31 further comprising:

a pulsed ion deflector for extracting ions from their oscillating orbit in said first ion trap and injecting them into said second ion trap for further processing; and wherein the second ion trap comprises a second pair of opposing ion reflectors and a drift region that provide an electric field in which said ions make isochronous oscillations, said second pair of reflectors being arranged in parallel to said first pair of reflectors;

a voltage supply for feeding the ion reflectors with constant DC voltages; means for sensing transients of said oscillations between said first pair and said second pair of reflectors;

a data acquisition system capable of producing a mass spectrum by transforming said oscillation transients.

42. An electrostatic ion trap apparatus for mass analysis or mass separation of a population of ions comprising:

means to generate ions or means to introduce existing ions into said apparatus;

two opposing ion reflectors and a drift region that provide an electric field in which said ions make isochronous oscillations, whereby said ion reflectors each comprise a plurality of electrodes;

a voltage supply for feeding the ion reflectors with constant DC voltages;

means for sensing a transient of said oscillations;

a data acquisition system capable of producing a mass spectrum by transforming said oscillation transient;

an ion injection mechanism to inject said ions into said trap; and a device for isolating one or several species of ions in said trap by changing the potential of one or several of said electrodes of said ion reflectors at least once for a certain time span causing chances in the trajectory of one or several species of ions that are flying close to the one or several of said electrodes, wherein said changes lead to an orbit of selected ions in such a way that said selected ions exit the trap or hit an electrode of said trap and get lost or wherein said changes lead to an orbit of selected ions in such a way that said selected ions are injected into a second ion trap for further processing.

43. The electrostatic ion trap of claim 42 wherein said second ion trap comprises a second pair of opposing ion reflectors and a drift region that provide an electric field in which said ions make isochronous oscillations, said second pair of reflectors being arranged in parallel to said first pair of reflectors;

a voltage supply for feeding the ion reflectors with constant DC voltages; means for sensing transients of said oscillations between said second pair of reflectors;

a data acquisition system capable of producing a mass spectrum by transforming said oscillation transients.

44. An electrostatic ion trap apparatus for mass analysis or mass separation of a population of ions comprising:

means to generate ions or means to introduce existing ions into said apparatus;

two opposing ion reflectors and a drift region that provide an electric field in which said ions make isochronous oscillations, whereby said ion reflectors are constituted by a plurality of electrostatic elements whereby said elements of each of said reflectors are high-frequency coupled;

a voltage supply for feeding said ion reflectors with constant DC voltages;

a first pick-up electrode and a second pick-up electrode, whereby a differential voltage between said first and second pick-up electrodes is sensed in order to obtain a transient of said oscillations;

a data acquisition system capable of producing a mass spectrum by transforming said oscillation transient; and an ion injection mechanism to inject said ions into said trap, whereby said first pick-up electrode and said second pick-up electrode are caps, said first pick-up electrode coupled to a first of said ion reflectors and said second pick-up electrode coupled to another of said ion reflectors.

45. An electrostatic ion trap apparatus for mass analysis or mass separation of a population of ions comprising:

means to generate ions or means to introduce existing ions into said apparatus;

two opposing ion reflectors and a drift region that provide an electric field in which said ions make isochronous oscillations;

means for sensing a transient of said oscillations;

a data acquisition system capable of producing a mass spectrum by transforming said oscillation transient;

an ion injection mechanism to inject said ions into said trap; and means for fragmenting said injected ions inside said trap and wherein said fragmentation means comprises an electron generator for generating low energetic electrons and a grid arranged in a back plate of one of said ion reflectors, whereby said electron generator is arranged such that said low energetic electrons enter said ion reflector through said grid.

46. An electrostatic ion trap apparatus for mass analysis or mass separation of a population of ions comprising:

means to generate ions or means to introduce existing ions into said apparatus;

two opposing ion reflectors and a drift region that provide an electric field in which said ions make isochronous oscillations;

a voltage supply for feeding the ion reflectors with constant DC voltages;

means for sensing a transient of said oscillations;

a data acquisition system capable of producing a mass spectrum by transforming said oscillation transient;

an ion injection mechanism to inject said ions into said trap; and a fragmentation device to fragment said pre-selected ions into fragment ions, in order to perform a tandem MS/MS analysis in a single ion trap, wherein said fragmentation occurs in a turning point of said oscillations in either of said reflectors, wherein said fragmentation is caused by surface induced fragmentation (SID) or beam induced fragmentation.

* * * * *